US012662294B2

(12) United States Patent
Peterson et al.

(10) Patent No.: US 12,662,294 B2
(45) Date of Patent: Jun. 23, 2026

(54) CHILD RESISTANT PACKAGING

(71) Applicant: Hub Folding Box Company, Inc., Mansfield, MA (US)

(72) Inventors: Zane Peterson, Blackstone, MA (US); David Kamyk, Worcester, MA (US)

(73) Assignee: Hub Folding Box Company, Inc., Mansfield, MA (US)

( * ) Notice: Subject to any disclaimer, the term of this patent is extended or adjusted under 35 U.S.C. 154(b) by 0 days.

(21) Appl. No.: 18/794,208

(22) Filed: Aug. 5, 2024

(65) Prior Publication Data

US 2024/0391661 A1 Nov. 28, 2024

Related U.S. Application Data

(63) Continuation-in-part of application No. 17/314,592, filed on May 7, 2021, now Pat. No. 12,054,324.
(Continued)

(51) Int. Cl.
*B65D 50/04* (2006.01)
*B65D 5/02* (2006.01)
(Continued)

(52) U.S. Cl.
CPC ..... *B65D 50/046* (2013.01); *B65D 5/38* (2013.01); *B65D 5/563* (2013.01)

(58) Field of Classification Search
CPC . B65D 5/38; B65D 5/48; B65D 5/563; B65D 50/046; B65D 2215/02; B65D 2215/04
(Continued)

(56) References Cited

U.S. PATENT DOCUMENTS 174,332 A 2/1876 White
729,461 A 5/1903 Webb
(Continued)

FOREIGN PATENT DOCUMENTS

DE 102010014429 A1 10/2011
DE 202014001622 U1 4/2014
(Continued)

OTHER PUBLICATIONS

PCT International Preliminary Report on Patentability in International Appln. No. PCT/US2021/031332, dated Nov. 17, 2022, 9 pages.
(Continued)

*Primary Examiner* — Luan K Bui
(74) *Attorney, Agent, or Firm* — Fish & Richardson P.C.

(57) ABSTRACT

A container that includes an outer sleeve and an inner tray and is configured to have an open state and a closed state. The outer sleeve includes side panels defining a chamber having a first opening. The inner tray includes side panels defining a space for holding a product, and a second opening. In the open state, the inner tray extends out of the outer sleeve through the first opening. The inner tray includes a cover panel and a tuck flap that includes an extension member and a tuck flap locking member. In the closed state, the cover panel covers the second opening, and the extension member and the tuck flap locking member are tucked between a side panel of the inner tray and a side panel of the outer sleeve. The tuck flap locking member engages an inner locking member of the outer sleeve and prevents the tray from extending out of the sleeve.

20 Claims, 27 Drawing Sheets

Related U.S. Application Data

(60) Provisional application No. 63/021,450, filed on May 7, 2020.

(51) Int. Cl.
*B65D 5/38* (2006.01)
*B65D 5/56* (2006.01)

(58) Field of Classification Search
USPC ..... 206/1.5, 468, 528, 538; 229/125.125
See application file for complete search history.

(56) References Cited

U.S. PATENT DOCUMENTS

| | | | | |
|---|---|---|---|---|
| 2,072,256 | A | 3/1937 | Greve | |
| 2,491,278 | A | 12/1949 | Ringler | |
| 3,198,416 | A | 8/1965 | Hickin et al. | |
| 4,175,675 | A | 11/1979 | Maisonneuve | |
| 4,830,270 | A | 5/1989 | Holmes | |
| 5,065,937 | A | 11/1991 | Ritter | |
| 5,275,291 | A | 1/1994 | Sledge | |
| 5,350,108 | A | 9/1994 | Friar et al. | |
| 6,047,829 | A * | 4/2000 | Johnstone | B65D 83/0463 229/125.125 |
| 6,079,563 | A | 6/2000 | Katchmazenski | |
| 6,641,031 | B2 * | 11/2003 | Evans | B65D 77/02 206/532 |
| 7,637,375 | B2 | 12/2009 | Sattel et al. | |
| 7,819,250 | B2 | 10/2010 | Sattel et al. | |
| 8,342,330 | B2 | 1/2013 | Weston et al. | |
| 9,926,125 | B2 | 3/2018 | Whitehurst | |
| 10,479,581 | B2 | 11/2019 | Chambers et al. | |
| 10,640,257 | B1 | 5/2020 | Kraus et al. | |
| 10,730,671 | B2 * | 8/2020 | Drosos | B65D 50/066 |
| 11,111,052 | B2 | 9/2021 | Hengami | |
| 11,319,108 | B2 | 5/2022 | Gauvin | |
| 11,345,506 | B2 | 5/2022 | Dixon | |
| 11,396,411 | B2 | 7/2022 | Britton et al. | |
| 11,628,990 | B2 * | 4/2023 | Chambers | B65D 50/066 206/1.5 |
| 11,897,670 | B2 * | 2/2024 | Dayioglu | B65D 5/38 |
| 12,054,324 | B2 | 8/2024 | Kamyk | |
| 2005/0173505 | A1 | 8/2005 | Howell et al. | |
| 2008/0156686 | A1 | 7/2008 | Hluchan et al. | |
| 2009/0184023 | A1 | 7/2009 | Brollier et al. | |
| 2010/0116693 | A1 | 5/2010 | Hession | |
| 2012/0234701 | A1 * | 9/2012 | Albrecht | B65D 83/0463 206/1.5 |
| 2013/0075462 | A1 | 3/2013 | Jones et al. | |
| 2014/0138262 | A1 | 5/2014 | Rajter | |
| 2015/0307246 | A1 * | 10/2015 | Patwardhan | B65D 77/0433 206/1.5 |
| 2018/0022498 | A1 | 1/2018 | Everett | |
| 2018/0244425 | A1 | 8/2018 | Bressan et al. | |
| 2019/0315513 | A1 | 10/2019 | Hengami | |
| 2019/0329930 | A1 | 10/2019 | Davis | |
| 2020/0180808 | A1 | 6/2020 | Gauvin | |
| 2020/0180828 | A1 | 6/2020 | Cho et al. | |
| 2020/0331667 | A1 | 10/2020 | Bressan et al. | |
| 2021/0016939 | A1 * | 1/2021 | Palmer | B65D 5/38 |
| 2021/0347539 | A1 | 11/2021 | Peterson | |
| 2022/0061599 | A1 | 3/2022 | Blair | |
| 2022/0081174 | A1 | 3/2022 | Culligan et al. | |

FOREIGN PATENT DOCUMENTS

| | | | |
|---|---|---|---|
| DE | 202018005911 | U1 | 7/2019 |
| EP | 1044885 | A1 | 10/2000 |
| WO | WO 1994/008855 | A1 | 4/1994 |
| WO | WO 2018/222531 | A1 | 12/2018 |

OTHER PUBLICATIONS

PCT International Search Report and Written Opinion in International Appln. No. PCT/US2021/031332, dated Aug. 9, 2021, 11 pages.

* cited by examiner

CHILD RESISTANT PACKAGING

CROSS-REFERENCE TO RELATED APPLICATIONS

This application is a continuation-in-part of U.S. patent application Ser. No. 17/314,592, filed on May 7, 2021, which claims priority to U.S. provisional application 63/021,450, filed on May 7, 2020. The entire contents of the above applications are incorporated by reference.

TECHNICAL FIELD

This disclosure relates to child resistant packaging.

BACKGROUND

Child resistant ("CR"), senior friendly packaging has been used to safely store potentially hazardous materials, such as pharmaceuticals, for families with young children. In some examples, child resistant packages can be expensive to manufacture, complicated to produce, not senior friendly, or ineffective after multiple uses. In some examples, the child resistant packages include plastic material that may be difficult to recycle.

SUMMARY

In a general aspect, an apparatus includes a container that is configured to have a first state and a second state, the container including an outer sleeve and an inner sleeve. The outer sleeve includes a first set of side panels and an inner locking member. The first set of side panels define a first opening, the first set of side panels include a first side panel, and the inner locking member is attached to an inner wall of the first side panel. The inner sleeve includes a second set of side panels and an extension panel, the second set of side panels define a second opening. The second set of side panels include a fifth side panel, and the extension panel is coupled to the fifth side panel. The extension panel includes a cover panel and a tuck flap, and the tuck flap includes an extension member and a tuck flap locking member. In the first state of the container, the inner sleeve is positioned within the outer sleeve, the cover panel is configured to cover the second opening, the extension member and the tuck flap locking member are tucked between the inner sleeve and the outer sleeve, and the tuck flap locking member is configured to engage the inner locking member.

Implementations can include one or more of the following features. The container can include a release member configured to, upon receiving an external force, bias the tuck flap locking member to disengage from the inner locking member.

The release member can be formed by a predefined cut, crease, embossed area or graphically identified area on the first side panel of the outer sleeve.

The outer sleeve can include a rectangular or square cross sectional shape. The first set of side panels can include a second side panel, a third side panel, and a fourth side panel. The first and second side panels can be parallel to each other, and the third and fourth side panels can be parallel to each other.

The inner sleeve can include a sixth side panel, a seventh side panel, and an eighth side panel. The fifth side panel can be parallel to the sixth side panel, and the seventh side panel can be parallel to the eighth side panel. In the first state of the container, the tuck flap locking member and at least a portion of the extension member can be tucked between the first side panel of the outer sleeve and the sixth side panel of the inner sleeve.

The inner sleeve can include a bias member. When the container is in the first state, the bias member can be configured to bias the tuck flap locking member towards a first position to engage the inner locking member.

The outer sleeve can include a release member configured to, upon receiving an external force, bias the tuck flap locking member to a second position to disengage from the inner locking member.

The inner locking member and the first side panel of the outer sleeve can be formed by a first continuous sheet of material. The inner locking member can be folded at a first fold line inwards relative to the first side panel. The inner locking member can be secured to an inner wall of the first side panel, producing a first step profile in which a first step is formed by a first edge of the inner locking member.

The extension member and the tuck flap locking member can be formed by a second continuous sheet of material. The tuck flap locking member can be folded at a second fold line outwards relative to the extension member. In the first state of the container, the extension member and the tuck flap locking member can form a second step profile in which a second step is formed by a second edge of the tuck flap locking member. The second step profile can complement the first step profile. The second edge of the tuck flap locking member can engage the first edge of the inner locking member.

In the second state of the container, the tuck flap locking member of the inner sleeve can be disengaged from the inner locking member of the outer sleeve, enabling at least a portion of the inner sleeve to extend out of the outer sleeve. The outer sleeve can define an opening. The inner sleeve can include a first end and a second end. When the inner sleeve is fully in the outer sleeve, the first end is closer to the opening of the outer sleeve than the second end, and the tuck flap locking member is positioned closer to the first end than the second end. The inner sleeve can include a second locking member closer to the second end than the first end. The second locking member can have a third edge that is configured to engage the inner locking member of the outer sleeve when a predefined portion of the inner sleeve extends outside of the outer sleeve, preventing the inner sleeve to further extend out of the outer sleeve.

The first edge of the inner locking member can have a width that is greater than a width of the second edge of the tuck flap locking member. The third edge of the second locking member of the inner sleeve can have a width that is greater than the width of the second edge of the tuck flap locking member. The inner sleeve can include a release member having a width sufficient to bias the second edge of the tuck flap locking member to entirely disengage from the first edge of the inner locking member upon receiving a first external force. In this example, the width of the release member is not sufficient to bias the third edge of the second locking member to entirely disengage from the first edge of the inner locking member upon receiving a second external force comparable to the first external force.

The inner sleeve can include a sixth side panel, seventh side panel, and an eighth side panel. The fifth side panel can be parallel to the sixth side panel, and the seventh side panel can be parallel to the eighth side panel. The tuck flap locking member and at least a portion of the extension member can be tucked in the space between the first side panel and the fifth side panel when the container is in the first state.

The outer sleeve can be made of a first continuous sheet of material, and the inner sleeve can be made of a second continuous sheet of material.

The cover panel, the extension member, and the tuck flap locking member can be formed by a triple fold.

The container can include a folded board.

The container can include a folded paperboard or cardboard.

The container can include a lining on the paperboard to form a moisture or oil barrier, and enhance tear-resistant properties of the paperboard.

The lining can include at least one of polyresin or bioresin.

In another general aspect, an apparatus includes a container including an outer package and an inner tray, wherein the container is configured to have an open state and a closed state. The outer package includes an inner locking member, and the inner tray includes a tuck flap locking member. When the container is in the closed state, the inner tray is positioned within the outer package, and the tuck flap locking member is tucked between the inner tray and the outer package and configured to engage the inner locking member. The outer package includes a release member configured to, upon receiving an external force, bias the tuck flap locking member to disengage from the inner locking member, enabling the container to transition to the open state, allowing the inner tray to move relative to the outer package and extend at least partially outside of the outer package.

Implementations can include one or more of the following features. The release member can be formed by a predefined cut, crease, embossed area or graphically identified area on a side panel of the outer package.

The inner tray can include a fifth side panel, a sixth side panel, a seventh side panel, and an eighth side panel. The fifth side panel can be parallel to the sixth side panel, and the seventh side panel can be parallel to the eighth side panel. The inner tray can include an extension panel coupled to the fifth side panel. The extension panel can include a cover panel and a tuck flap, and the tuck flap can include an extension member and the tuck flap locking member. In the closed state of the container, the tuck flap locking member and at least a portion of the extension member can be tucked between the outer package and the sixth side panel of the inner tray.

The outer package can include a rectangular or square cross sectional shape. The outer package can include a first side panel, a second side panel, a third side panel, and a fourth side panel. The first and second side panels can be parallel to each other, the third and fourth side panels can be parallel to each other, and the inner locking member can be attached to an inner wall of the first side panel.

When the container is in the closed state, the sixth side panel can be configured to bias the tuck flap locking member towards a first position to engage the inner locking member on the outer package.

The release member can be configured to, upon receiving the external force, bias the tuck flap locking member to a second position to disengage from the inner locking member.

The cover panel, the extension member, and the tuck flap locking member can be formed by a triple fold.

The outer package can include a first side panel. The inner locking member and the first side panel can be formed by a first continuous sheet of material. The inner locking member can be folded at a first fold line inwards relative to the first side panel. The inner locking member can be secured to an inner wall of the first side panel producing a first step profile in which a first step is formed by a first edge of the inner locking member.

The inner container can include a fifth side panel and an extension panel coupled to the fifth side panel. The extension panel can include a cover panel and a tuck flap, and the tuck flap can include an extension member and the tuck flap locking member. The extension member and the tuck flap locking member can be formed by a second continuous sheet of material, and the tuck flap locking member can be folded at a second fold line outwards relative to the extension member. In the closed state of the container, the extension member and the tuck flap locking member can be tucked between the inner tray and the outer package to cause the tuck flap to press against the extension member and form a second step profile in which a second step is formed by a second edge of the tuck flap locking member, and the second edge of the tuck flap locking member can engage the first edge of the inner locking member.

The inner tray can include a first end and a second end, and the tuck flap locking member can be positioned closer to the first end than the second end. The inner tray can include a second locking member closer to the second end than the first end. The second locking member can have a third edge that is configured to engage the inner locking member of the outer package when a predefined portion of the inner tray extends out of the outer package to prevent the inner tray from further extending out of the outer package.

The first edge of the inner locking member can have a width that is greater than a width of the second edge of the tuck flap locking member. The third edge of the second locking member of the inner tray can have a width that is greater than the width of the second edge of the tuck flap locking member. The release member can have a width sufficient to bias the second edge of the tuck flap locking member to entirely disengage from the first edge of the inner locking member upon receiving a first external force. In this example, the width of the release member is not sufficient to bias the third edge of the second locking member to entirely disengage from the first edge of the inner locking member upon receiving a second external force comparable to the first external force.

The inner tray can include a second locking member. When the container is in the open state, the second locking member can be configured to engage the inner locking member of the outer package when a predefined portion of the inner tray extends out of the outer package, preventing the inner tray from further extending out of the outer package.

The outer package can include a first side panel, and the inner tray can include a fifth side panel. The inner locking member and the first side panel can be made of a first continuous sheet of material, and the extension panel and the fifth side panel can be made of a second continuous sheet of material.

The bias member can include a panel that divides the chamber into a first sub-chamber and a second sub-chamber. The first sub-chamber can be configured to receive an object to be stored in the container, the second sub-chamber can be configured to receive the extension member and the tuck flap locking member when the container is in the closed state.

In another general aspect, a method of packaging a product is provided, the method includes: providing a container comprising an outer package and an inner tray, wherein the container is configured to have an open state and a closed state. The outer package includes an inner locking member, and the inner tray includes a tuck flap locking member. The method includes placing the product in the inner tray; and closing the container by inserting the inner tray into the outer package, tucking the tuck flap locking member between the inner tray and the outer package, causing the tuck flap locking member to engage the inner locking member, and transitioning the container to the closed state. The outer package includes a release member configured to, upon receiving an external force, bias the tuck flap locking member to disengage from the inner locking member, enabling the container to transition to the open state, allowing the inner tray to move relative to the outer package and extend at least partially outside of the outer package.

In another general aspect, an apparatus includes a container that includes an outer sleeve and an inner tray. The outer sleeve includes side panels defining a chamber having a first opening, the side panels including a first side panel. The inner tray includes side panels defining a space for holding a product. The side panels define a second opening, and the side panels include a fifth side panel. The inner tray is configured to extend out of the outer sleeve through the first opening. The inner tray further includes an extension panel that includes a cover panel and a tuck flap, and the tuck flap includes an extension member and a tuck flap locking member. The extension panel and the first side panel are formed by a first continuous sheet of material. The cover panel, the extension member, and the tuck flap locking member are formed by a triple fold. In a closed state of the container, the cover panel is configured to cover the second opening, and the extension member and the tuck flap locking member are tucked between a fifth side panel of the inner tray and the first side panel of the outer sleeve. The outer sleeve includes an inner locking member positioned in the chamber. The fifth side panel of the inner tray is configured to bias the tuck flap locking member towards a first position when the container is in the closed state and cause the tuck flap locking member to engage the inner locking member of the outer sleeve.

Implementations can include one or more of the following features. The container can include a release member configured to, upon receiving an external force, bias the tuck flap locking member to a second position to cause the tuck flap locking member to disengage from the inner locking member.

In another general aspect, an apparatus includes a container including an outer cell and an inner cell. The outer cell includes a first continuous sheet of material forming side panels, an inner locking member, and a release member, wherein the outer cell defines a chamber having a first opening. The inner cell includes a second continuous sheet of material forming side panels and an extension panel. The inner cell has dimensions selected to enable the inner cell to fit in the chamber of the outer cell. The extension panel is coupled to one of the side panels, and the extension panel includes an extension member and a tuck flap locking member. When the container is in a closed state, the inner cell is fully inserted into the chamber of the outer cell and the tuck flap locking member is tucked between one of the side panels of the inner cell and one of the side panels of the outer cell, and the tuck flap locking member is configured to engage the inner locking member. The release member is configured to, upon receiving an external force, bias the tuck flap locking member to disengage from the inner locking member, enabling the inner cell to extend from the outer cell through the first opening.

Implementations can include one or more of the following features. The inner cell can define a second opening. The extension panel can include a cover panel and a tuck flap, and the tuck flap can include the extension member and the tuck flap locking member. When the container is in the closed state, the cover panel can be configured to cover the second opening.

In another general aspect, an apparatus includes a container including an outer cell and an inner cell. The outer cell includes an inner locking member. The inner cell includes a cover panel and a tuck flap formed by a triple fold. In a closed state of the container, the cover panel is configured to cover an opening of the inner cell, and at least a portion of the tuck flap is configured to be tucked between the outer cell and the inner cell and engage an inner locking member. The container further includes a release member configured to bias the tuck flap to disengage from the inner locking member, enabling the container to operate in an open state, allowing the inner cell to extend from the outer cell through an opening of the outer cell.

Implementations can include one or more of the following features. The container can include a folded board.

The container can include a folded paperboard or cardboard.

The container can include a lining on the paperboard to form a moisture or oil barrier, and enhance tear-resistant properties of the paperboard.

The lining can include at least one of polyresin or bioresin.

In another general aspect, an apparatus includes a container that is configured to have an open state and a closed state, in which the container includes an outer cell, an inner locking member, an extension panel, and a bias member. The outer cell includes a plurality of side panels including a first side panel and a second side panel, in which the second side panel is spaced apart from the first side panel, and the outer cell defines a chamber having a first opening. The inner locking member is attached to an inner wall of the first side panel. The extension panel is coupled to the second side panel, in which the extension panel includes a first cover panel and a tuck flap, and the tuck flap includes an extension member and a tuck flap locking member. In the closed state of the container, the first cover panel is configured to cover the first opening, and the extension member and the tuck flap locking member are tucked inside the chamber. The bias member is configured to bias the tuck flap locking member toward a first position to cause the tuck flap locking member to engage the inner locking member.

Implementations of the aspect can include one or more of the following features. The container can include a release member configured to, upon receiving an external force, bias the tuck flap locking member to a second position to cause the tuck flap locking member to disengage from the inner locking member.

The release member can be formed by a predefined cut, crease, embossed area or graphically identified area.

The outer cell can include a rectangular or square cross sectional shape, the outer cell can include a third side panel and a fourth side panel, the first and second side panels can be parallel to each other, and the third and fourth side panels can be parallel to each other.

The container can include an inner cell, the bias member can be part of the inner cell, the inner cell can include a fifth panel and a sixth panel, the fifth panel can be attached to an inner side of the third side panel, and the sixth panel can be attached to an inner side of the fourth side panel.

The outer cell and the inner cell can be made of a continuous sheet of material.

The fourth side panel can be connected to a first side of the first side panel, a second side of the first side panel can be connected to a first side of the third side panel, a second side of the third side panel can be connected to a first side of the second side panel, a second side of the second side panel can be connected to a first side of the sixth panel, a second side of the sixth panel can be connected to a first side of the bias member, and a second side of the bias member can be connected to the fifth panel.

The inner locking member and the first side panel can be made of a continuous sheet of material, and the extension panel and the second side panel can be made of a continuous sheet of material.

The bias member can include a panel that divides the chamber into a first sub-chamber and a second sub-chamber, the first sub-chamber can be configured to receive an object to be stored in the container, the second sub-chamber can be configured to receive the extension member and the tuck flap locking member when the container is in the closed state.

The first side panel can be parallel to the second side panel, and the bias member can include a bias panel that is parallel to the first and second side panels.

The bias panel can be spaced apart from the first side panel at a first distance, the bias panel can be spaced apart from the second side panel at a second distance, and the second distance can be at least twice the first distance.

The inner locking member can include an inner locking tab that is coupled to the first side panel, folded inward into the chamber, and attached to the inner wall of the first side panel. The bias panel can be spaced apart from the inner locking tab at a distance that is larger than combined thicknesses of the extension member and the tuck flap locking member.

The first cover panel, the extension member, and the tuck flap locking member can be formed by an outer triple fold.

The container can include an inner sleeve, the bias member can be part of the inner sleeve, and the outer sleeve and the inner sleeve can be formed using a continuous sheet of material.

The container can include a second cover panel that is coupled to the inner sleeve, and both the first cover panel and the second cover panel can cover the first opening when the container is in the closed state.

In another general aspect, an apparatus includes a container, in which the container includes side panels, an extension panel, a bias member, and an inner locking member. The side panels define a chamber having an opening. The extension panel includes a first cover panel and a tuck flap, in which the tuck flap includes an extension member and a tuck flap locking member. The first cover panel, the extension member, and the tuck flap locking member are formed by an outer triple fold. In a closed state of the container, the first cover panel is configured to cover the first opening, and the extension member and the tuck flap locking member are tucked inside the chamber. The bias member is configured to bias the tuck flap locking member toward a first position when the container is in the closed state. The inner locking member is positioned inside the chamber and configured to engage the tuck flap locking member when the tuck flap locking member is in the first position.

Implementations of the above aspects can include one or more of the following features. The container can include a release member configured to, upon receiving an external force, bias the tuck flap locking member to a second position to cause the tuck flap locking member to disengage from the inner locking member.

In another general aspect, an apparatus includes a container, in which the container includes an outer cell, an inner cell, an inner locking member, and an extension panel. The outer cell includes a first side panel, a second side panel, a third side panel, and a fourth side panel, in which the first side panel is connected to a first side of the second side panel, a second side of the second side panel is connected to a first side of the third side panel, a second side of the third side panel is connected to a first side of the fourth side panel, wherein the outer cell defines a chamber having a first opening. The inner cell includes a fifth panel, a sixth panel, and a seventh panel, in which a second side of the fourth side panel is connected to a first side of the fifth panel, a second side of the fifth panel is connected to a first side of the sixth panel, a second side of the sixth panel is connected to a first side of the seventh panel. The fifth panel is attached to an inner side of the first side panel, the seventh panel is attached to an inner side of the third side panel, and the sixth panel is spaced apart from the second side panel and the fourth side panel. The fourth side panel, the fifth panel, the sixth panel, and the seventh panel define a first chamber, and the second side panel and the sixth panel define a second chamber. The inner locking member is disposed in the second chamber. The extension panel is coupled to the fourth side panel, in which the extension panel includes a first cover panel and a tuck flap, and the tuck flap includes an extension member and a tuck flap locking member. In a closed state of the container, the first cover panel is configured to cover the first opening, the extension member and the tuck flap locking member are tucked inside the second chamber, and the sixth panel is configured to bias the tuck flap locking member to a first position to engage the inner locking member.

Implementations of the above aspects can include one or more of the following features. The container can include a release member configured to, upon receiving an external force, bias the tuck flap locking member to a second position to cause the tuck flap locking member to disengage from the inner locking member.

In another general aspect, an apparatus includes a container having a cover panel and a tuck flap formed by an outer triple fold, in which in a closed state of the container, the cover panel is configured to cover an opening of the container, and the tuck flap is configured to be inserted into a chamber of the container and engage an inner locking member.

Implementations of the above aspects can include one or more of the following features.

The apparatus can include a release member configured to, upon receiving an external force, bias the tuck flap to disengage from the inner locking member.

The container can include a folded board.

The container can include a folded paperboard or cardboard.

The container can include a lining on the paperboard to form a moisture or oil barrier and enhance the tear-resistant properties of the paperboard.

The lining can include at least one of polyresin or bioresin.

The details of one or more embodiments of the subject matter described in this specification are set forth in the accompanying drawings and the description below. Other features, aspects, and advantages of the invention will become apparent from the description, the drawings, and the claims.

DETAILED DESCRIPTION

This description relates in general to a recyclable child resistant package or carton, which can be made of, e.g., paperboard. In some implementations, a recyclable child resistant package includes an outer sleeve that defines a partial enclosure having an opening, a cover mechanism for covering the opening, and a locking mechanism for locking the cover mechanism in a manner that is child resistant and senior friendly.

Figure 1:
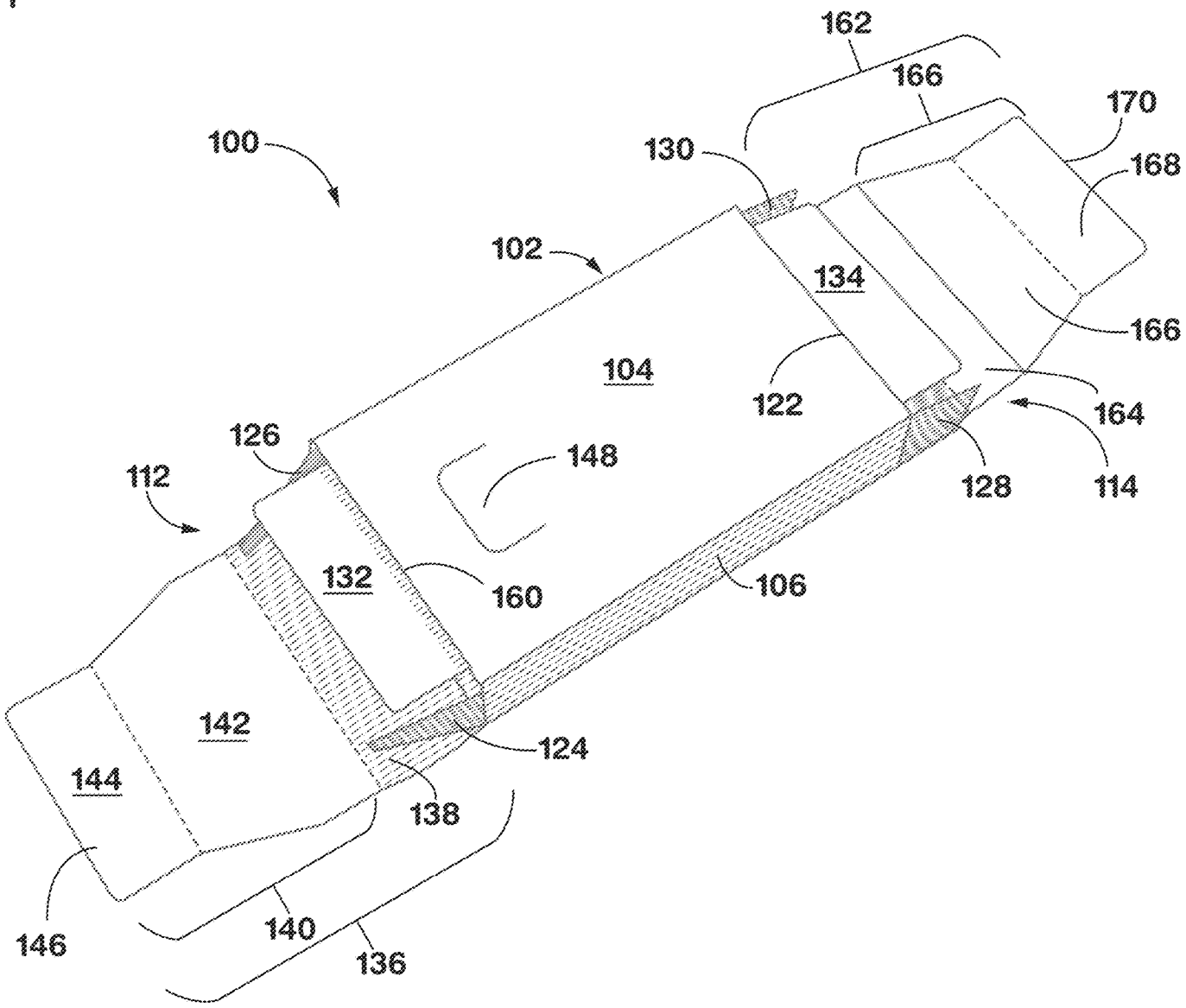
FIG. 1 is an image showing a perspective view of an example of a child resistant paperboard package in which two ends of the package are open.

FIGS. 1 to 7 show images of an example of a recyclable child resistant package 100. FIG. 1 is a perspective view of the recyclable child resistant package 100 that is partially assembled in which two ends of the package 100 are open. In some implementations, the child resistant package 100 includes an outer cell 102 having a first side panel 104, a second side panel 106, a third side panel 108 (which is opposite to the first side panel 104, see FIG. 6), and a fourth side panel 110 (which is opposite to the second side panel 106, see FIG. 7) that define a partial enclosure having a first opening 112 and a second opening 114.

An inner cell 116 (obscured from view in the figure) includes a fifth panel 150 (see FIG. 3) that is spaced apart from the first side panel 104 by a small, predetermined distance (e.g., about 1/32 to 1/16 of an inch). The inner cell 116 divides the partial enclosure into a first chamber 152 and a second chamber 154 (see FIGS. 3 and 7). The first chamber 152 is between the third side panel 108 and the fifth panel 150, and the second chamber 154 is between the first side panel 104 and the fifth panel 150. The first chamber 152 is the main chamber of the package 100 and is used for holding items (e.g., medicine) to be contained in the package. In some examples, the inner cell 116 includes a sixth panel 156 and a seventh panel 158 (see FIG. 6), in which the sixth panel 156 is attached to an inner side of the second side panel 106, and the seventh panel 158 is attached to an inner side of the fourth side panel 110, thereby allowing the fifth panel 150 to maintain the predetermined distance from the first side panel 104.

In some implementations, a first inner locking tab 118 (see FIG. 7) is coupled to a first end 160 of the first side panel 104, folded inwards, and attached to an inner wall of the first side panel 104. The first inner locking tab 118 has an edge 119 (obscured from view in the figure) that faces towards the second opening 114. A second inner locking tab 120 (obscured from view in the figure) is coupled to a second end 122 of the first side panel 104, folded inwards, and attached to an inner wall of the first side panel 104. The second inner locking tab 120 has an edge 121 (obscured from view in the figure) that faces towards the first opening 112.

In some implementations, a first end flap 124 is coupled to a first end of the second side panel 106, and a second end flap 126 is coupled to a first end of the fourth side panel 110. A third end flap 128 is coupled to a second end of the second side panel 106, and a fourth end flap 130 is coupled to a second end of the fourth side panel 110. A first cover panel 132 is coupled to a first end of the fifth panel 150, and a second cover panel 134 is coupled to a second end of the fifth panel 150.

In some implementations, a first extension panel 136 is coupled to a first end of the third side panel 108. The first extension panel 136 includes a third cover panel 138 and a first tuck flap 140. The first opening 112 can be closed and locked using the following steps. The first cover panel 132, the first end flap 124, the second end flap 126, and the third cover panel 138 are folded inward to cover the first opening 112. The first tuck flap 140 is inserted into the second chamber 154 between the first side panel 104 and the fifth panel 150 (see FIGS. 3 and 4).

The first tuck flap 140 includes an extension 142 and a first tuck flap locking tab 144 that has an edge 146. The first tuck flap locking tab 144 is folded back (see FIGS. 2 to 4) such that when the first tuck flap 140 is fully inserted into the second chamber 154 (see FIG. 5), the edge 146 faces the first opening 112. The length of the extension 142 is designed such that the edge 146 of the first tuck flap locking tab 144 engages the edge 119 of the first inner locking tab 118. The fifth panel 150 biases extension 142 and the first tuck flap locking tab 144 toward the first side panel 104, which causes the edge 146 of the first tuck flap locking tab 144 to face the edge 119 of the first inner locking tab 118. If a user attempts to open the package 100 by pulling on the third cover panel 138, the edge 146 of the first tuck flap locking tab 144 will bump against the edge 119 of the first inner locking tab 118, preventing the first tuck flap 140 from being pulled out of the second chamber 154, and thereby locking the first extension panel 136.

The distance between the fifth panel 150 and the first inner locking tab 118 is slightly larger than the combined thicknesses of the extension member 142 and the first tuck flap locking tab 144 to allow the extension member 142 and the first tuck flap locking tab 144 to be easily inserted into the second chamber 154.

In some implementations, a release button 148 is provided by forming a cut (e.g., a U-shaped cut) in the first side panel 104. When a user presses down on the button 148, the button 148 pushes down on the first tuck flap locking tab 144 to cause the first tuck flap locking tab 144 to disengage from the first inner locking tab 118. This allows the user to pull the third cover panel 138 and the tuck flap 140 outward to cause the tuck flap 140 to be extracted from the second chamber 154, thereby revealing the first opening 112. Other types of release mechanisms can also be used. For example, the package 100 can have a release member formed by a predefined crease, embossed area, or graphically identified area.

The package 100 is child resistant because the use of the release button 148 (or another type of release mechanism) in combination with pulling the third cover panel 138 and the tuck flap 140 in order to open the package 100 may not be apparent to a child. It may not be apparent to the child the purpose of the cut line on the first side panel 104. At the same time, pressing the release button 148 in combination with pulling the third cover panel 138 and the tuck flap 140 is easy for an adult, hence the package 100 is senior friendly.

In some implementations, a second extension panel 162 is coupled to a second end of the third side panel 108. The second extension panel 162 includes a fourth cover panel 164 and a second tuck flap 166. The second opening 114 can be closed and locked using the following steps. The second cover panel 134, the third end flap 128, the fourth end flap 130, and the fourth cover panel 164 are folded inward to cover the second opening 114. The second tuck flap 166 is inserted into the second chamber 154 between the first side panel 104 and the fifth panel 150.

The second tuck flap 166 includes a second tuck flap locking tab 168 that has an edge 170. The second tuck flap locking tab 168 is folded back (in a manner similar to the first tuck flap locking tab 144) such that when the second tuck flap 166 is fully inserted into the second chamber 154, the edge 170 faces towards the second opening 114. The length of the extension 166 is designed such that the edge 170 of the second tuck flap locking tab 168 engages the edge 121 of the second inner locking tab 120. The fifth panel 150 biases the extension 166 and the second tuck flap locking tab 168 toward the first side panel 104, which causes the edge 170 of the first tuck flap locking tab 144 to face the edge 121 of the second inner locking tab 120. If a user attempts to open the package 100 by pulling on the fourth cover panel 164, the edge 170 of the second tuck flap locking tab 168 will bump against the edge 121 of the second inner locking tab 120, preventing the second tuck flap 166 from being pulled out of the second chamber 154, thereby locking the second extension panel 162 in place.

In the example shown in FIGS. 1 to 5, there is no release button for the second extension panel 162. After the second tuck flap 166 is fully inserted into the second chamber 154, the second extension panel 162 is locked in place, and the second tuck flap 166 cannot be pulled out of the second chamber 154 without significant effort.

Figure 2:
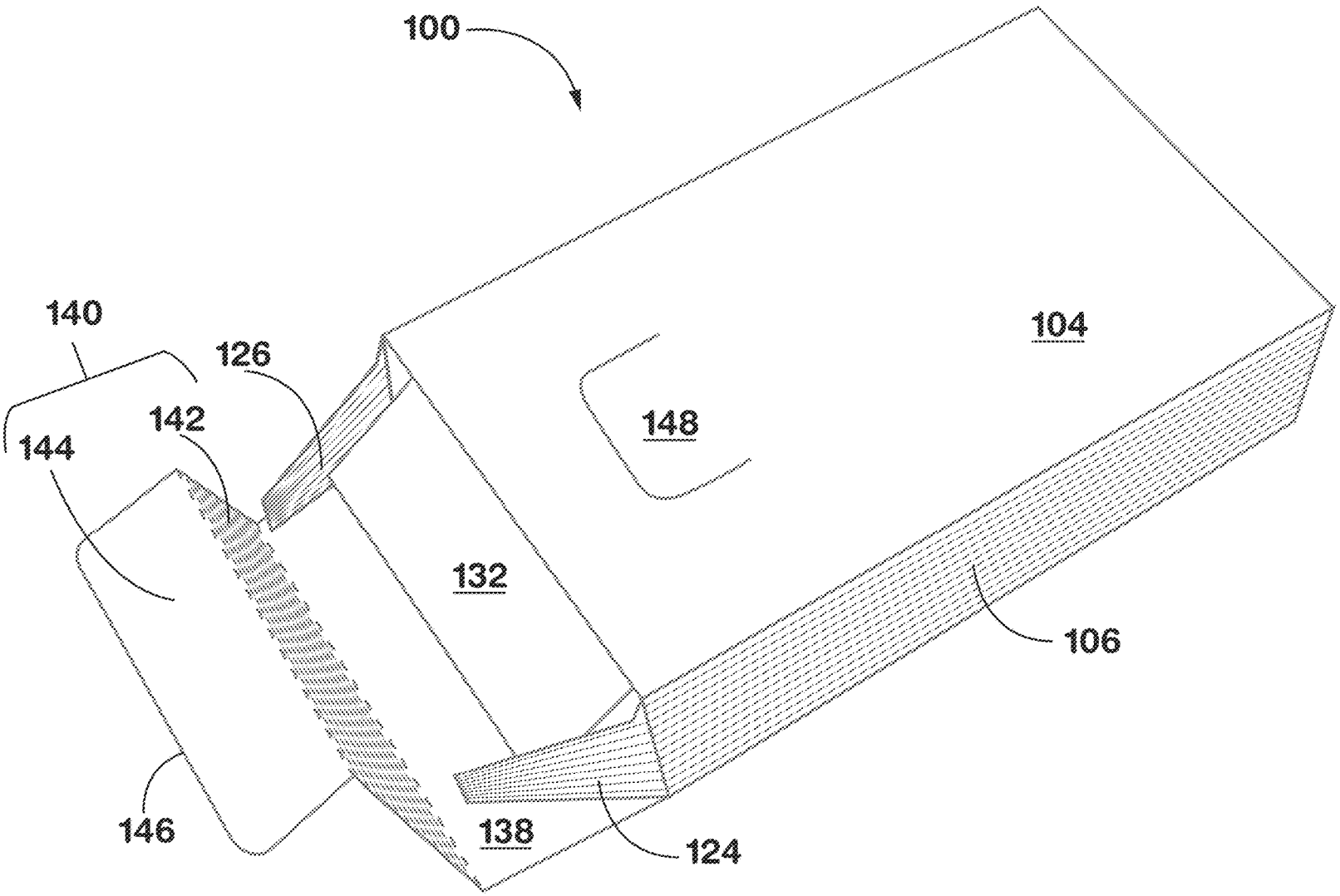
FIGS. 2 and 3 are images showing perspective views of the child resistant paperboard package in which one end of the package is closed.

FIG. 2 is a perspective view of the recyclable child resistant package 100 in which the first opening 112 remain open, and the second opening 114 is closed. The second tuck flap 166 is tucked into and locked inside the second chamber 154.

Figure 3:
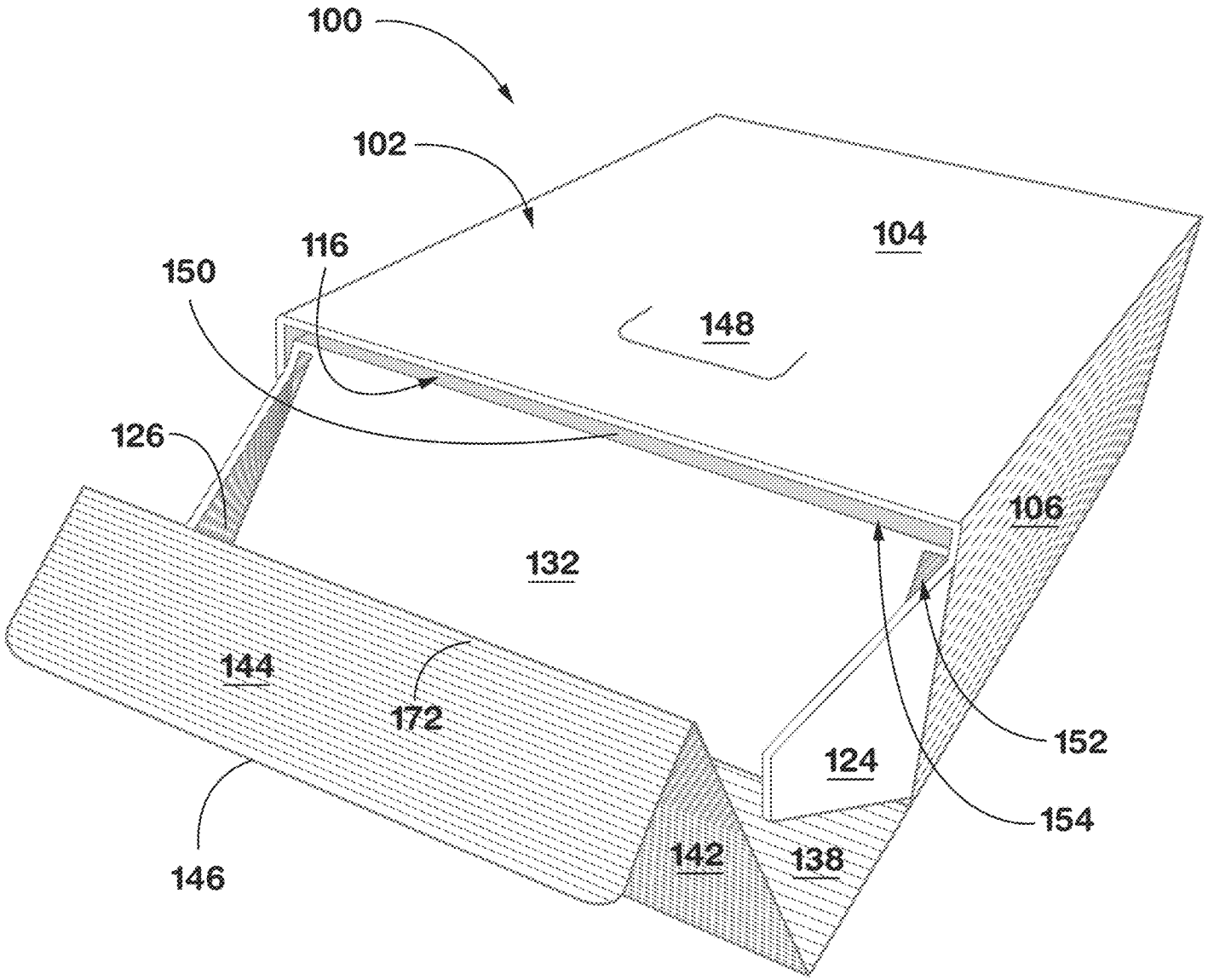

FIG. 3 is a perspective view of the recyclable child resistant package 100 showing the configuration of the first cover panel 132, the first end flap 124, the second end flap 126, the third cover panel 138, the extension 142, and the first tuck flap locking tab 144. The first chamber 152 and the second chamber 154 can be seen in FIG. 3.

A fold 172 between the extension 142 and the first tuck flap locking tab 144 is configured such that the first tuck flap locking tab 144 is at an angle (e.g., between 5 to 175 degrees) in an unbiased or uncompressed state. When the first tuck flap locking tab 144 and the extension 142 are squeezed into the narrow second chamber 154, there is a tendency for the first tuck flap locking tab 144 to flex towards the first side panel 104. In part due to the narrow width of the second chamber 154, the edge 146 of the first tuck flap locking tab 144 is biased against the inner side of the first side panel 104 and engages the edge 119 of the first inner locking tab 118, thereby locking the first extension panel 136 in place.

Figure 4:
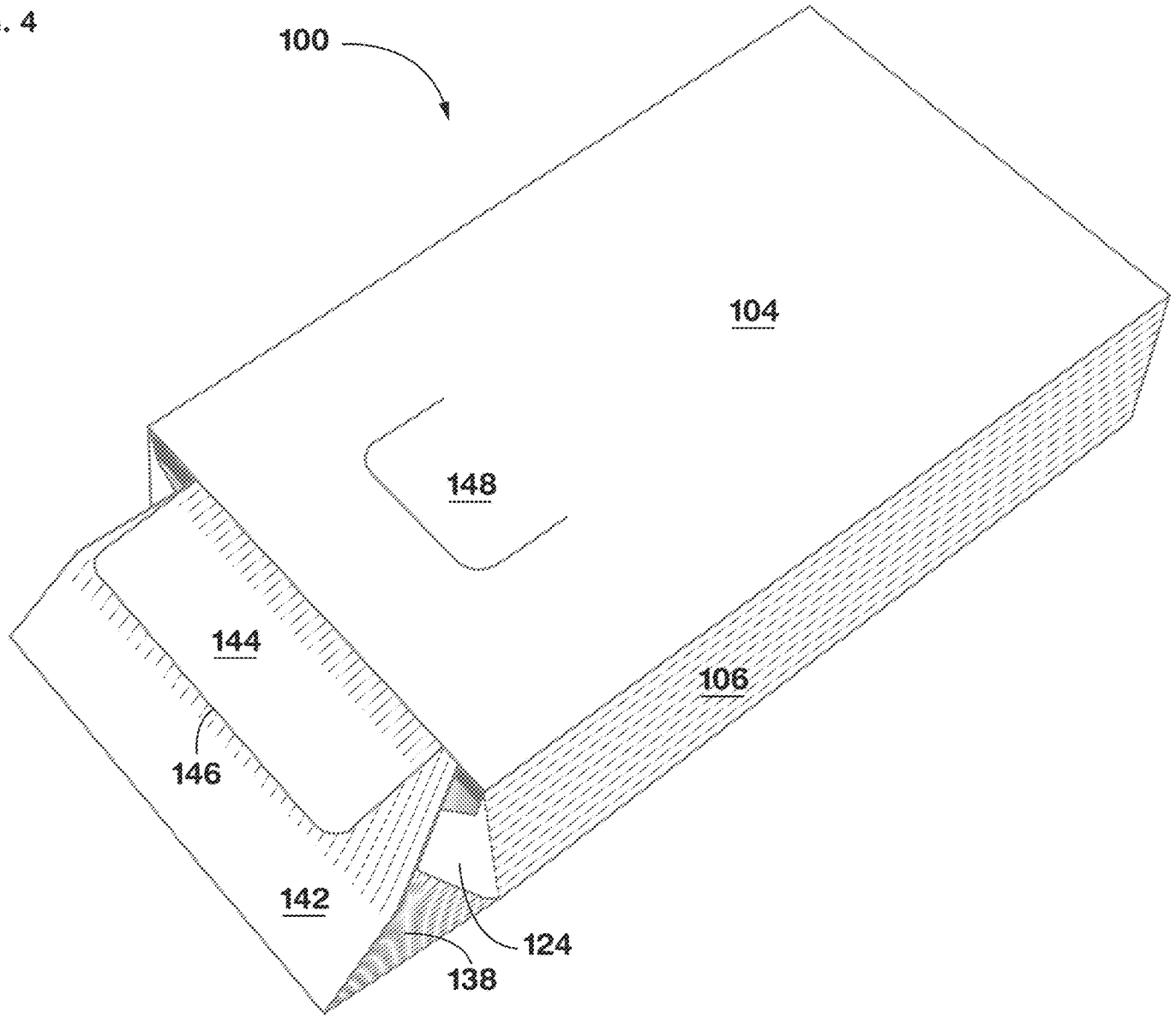
FIG. 4 is an image showing a perspective view of the child resistant paperboard package in which one end of the package is closed, and another end of the package has a tuck flap that is partially inserted into a chamber of the package.

FIG. 4 is a perspective view of the recyclable child resistant package 100 with the extension 142 and the first tuck flap locking tab 144 partly inserted into the second chamber 154.

Figure 5:
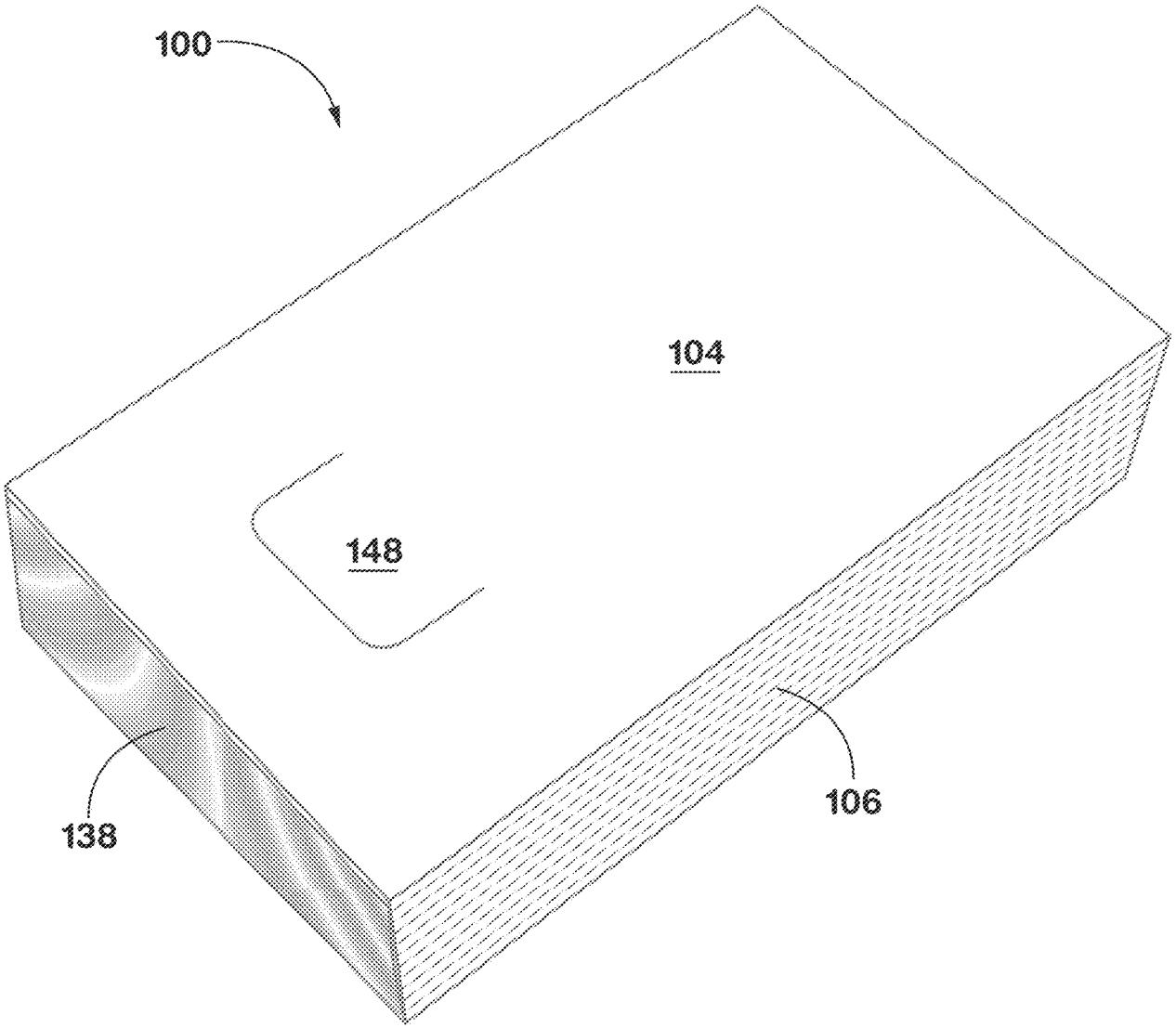
FIG. 5 is an image showing a perspective view of the child resistant paperboard package in which both ends of the package is closed.

FIG. 5 is a perspective view of the recyclable child resistant package 100 with the extension 142 and the first tuck flap locking tab 144 fully inserted into the second chamber 154, closing the first opening 112.

Figure 6:
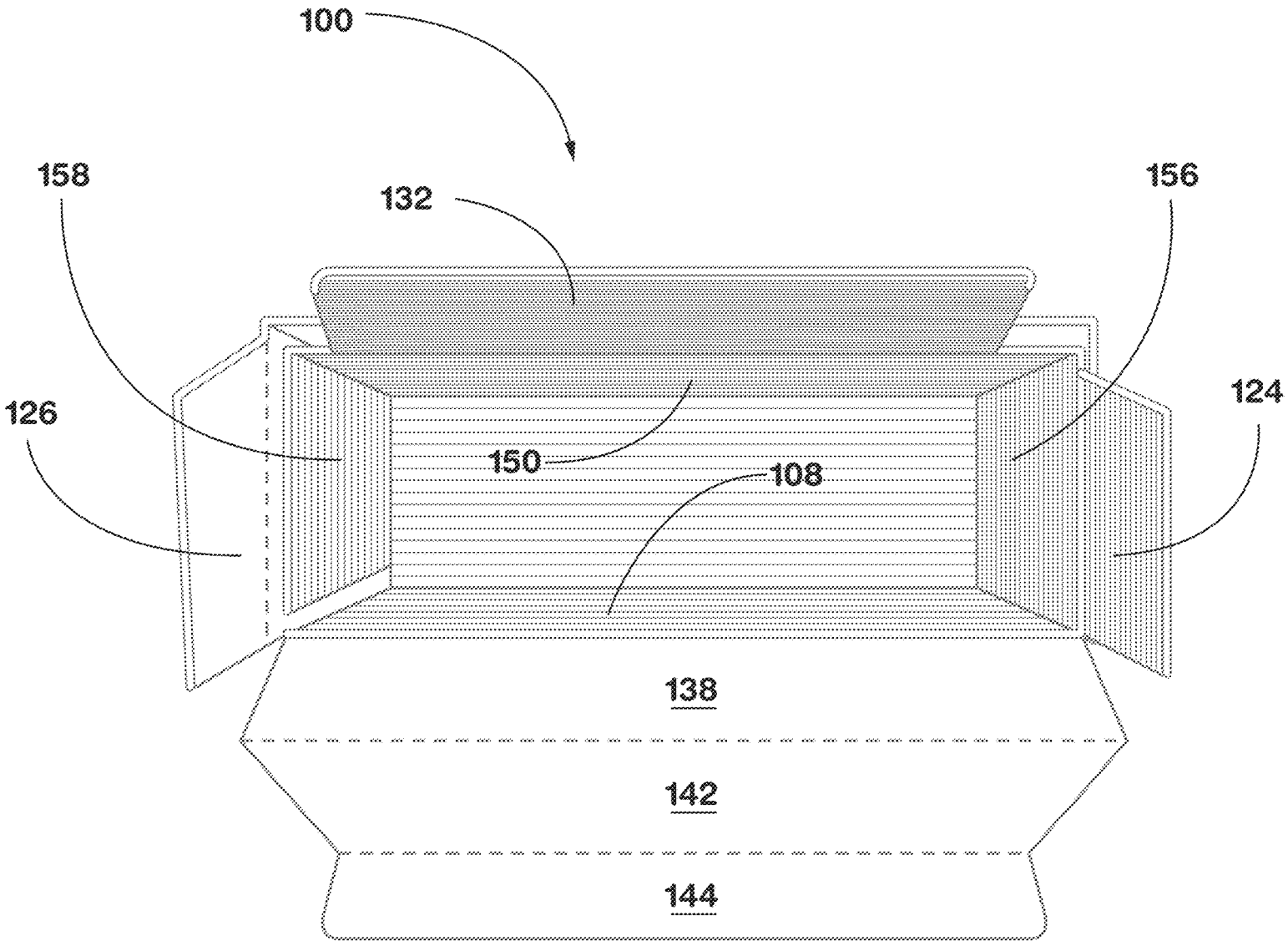
FIG. 6 is an image showing a first child resistant paperboard package placed on a second child resistant paperboard package, in which two ends of the first package are open, and two ends of the second package are closed.

FIG. 6 shows the first recyclable child resistant package 100 of FIG. 1 resting on a second recyclable child resistant package. The figure shows a view looking through the first chamber 152 from the first opening 112 to the second opening 114. As shown in the figure, the sixth panel 156 is attached to the inner side of the second side panel 106, and the seventh panel 158 is attached to the inner side of the fourth side panel 110, thereby allowing the fifth panel 150 to maintain the predetermined distance from the first side panel 104.

Figure 7:
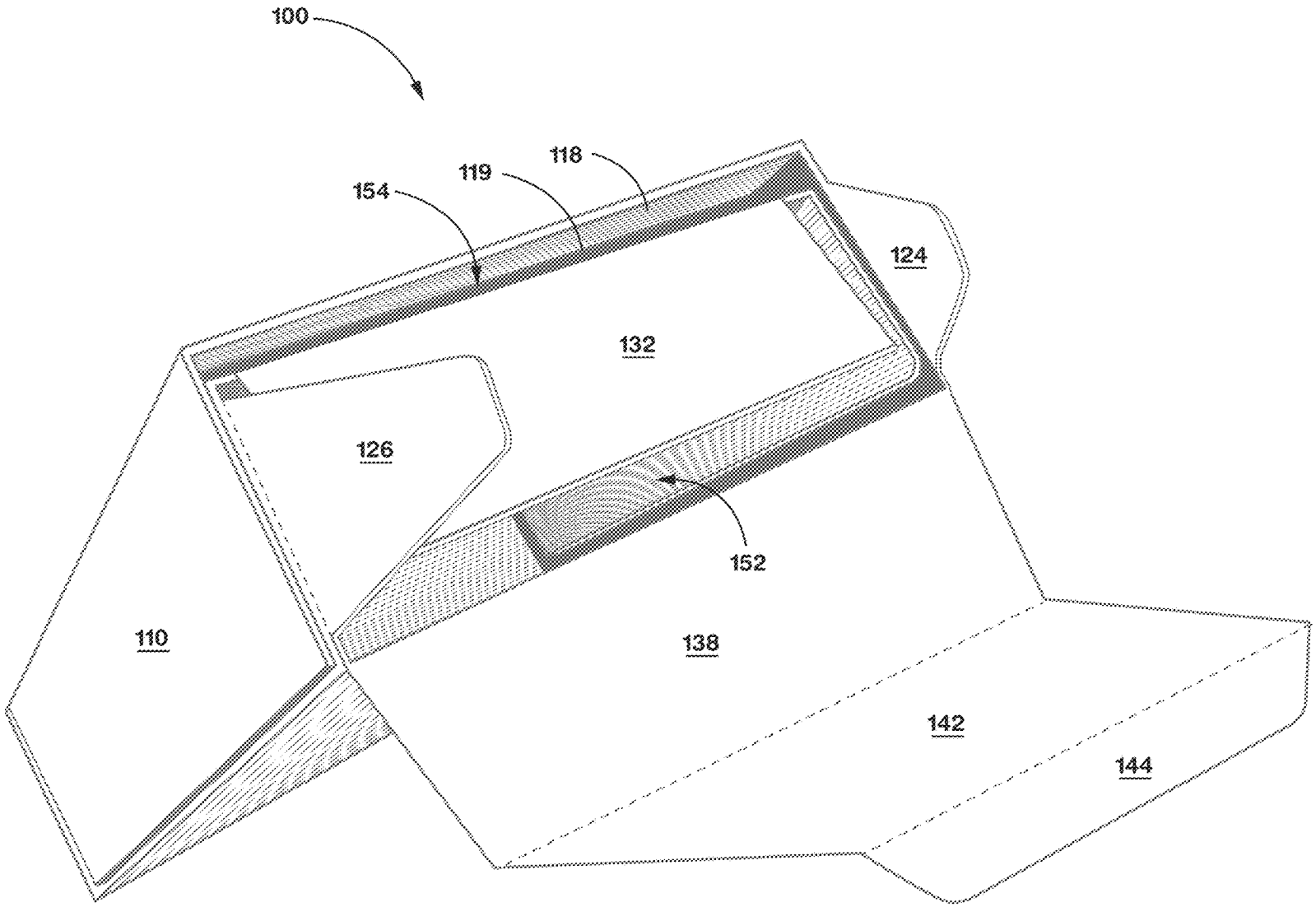
FIG. 7 is an image showing the child resistant paperboard package in which one end of the package is partially open.

FIG. 7 shows the first recyclable child resistant package 100 of FIG. 1, in which the first inner locking tab 118 and the edge 119 can be seen. As shown in the figure, when the first cover panel 132 covers the first opening 112, the second chamber 154 remains open and can receive the first tuck flap 140.

In some implementations, the recyclable child resistant package 100 can be made from a continuous sheet of material, such as a paperboard, a cardboard, or a sheet of paper pulp. For example, the fourth side panel 110 can be connected to the first side panel 104, which can be connected to the second side panel 106, which can be connected to the third side panel 108, which can be connected to the seventh panel 158, which can be connected to the fifth panel 150, which can be connected to the sixth panel 156. In this example, the inner sleeve and the outer sleeve of the package 100 are made of a continuous sheet of paperboard.

In some implementations, a second release button is provided to enable the user to pull the second tuck flap 166 from the second chamber 154. The second release button can have a configuration similar to, and can operate similar to, the first release button 148.

Figure 8A:
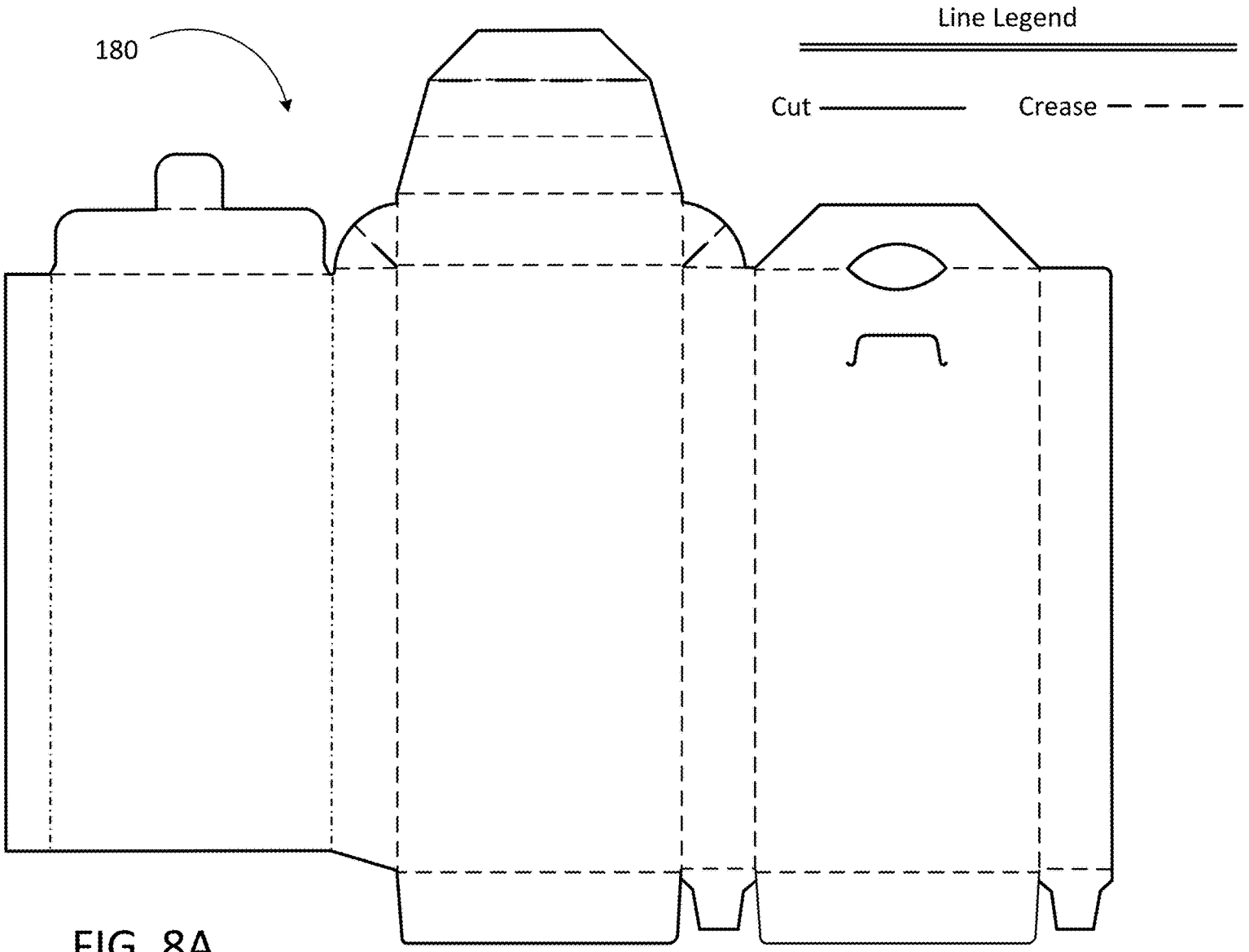
FIGS. 8A and 8B are diagrams of an example of a layout for a child resistant paperboard package.
Figure 8B:
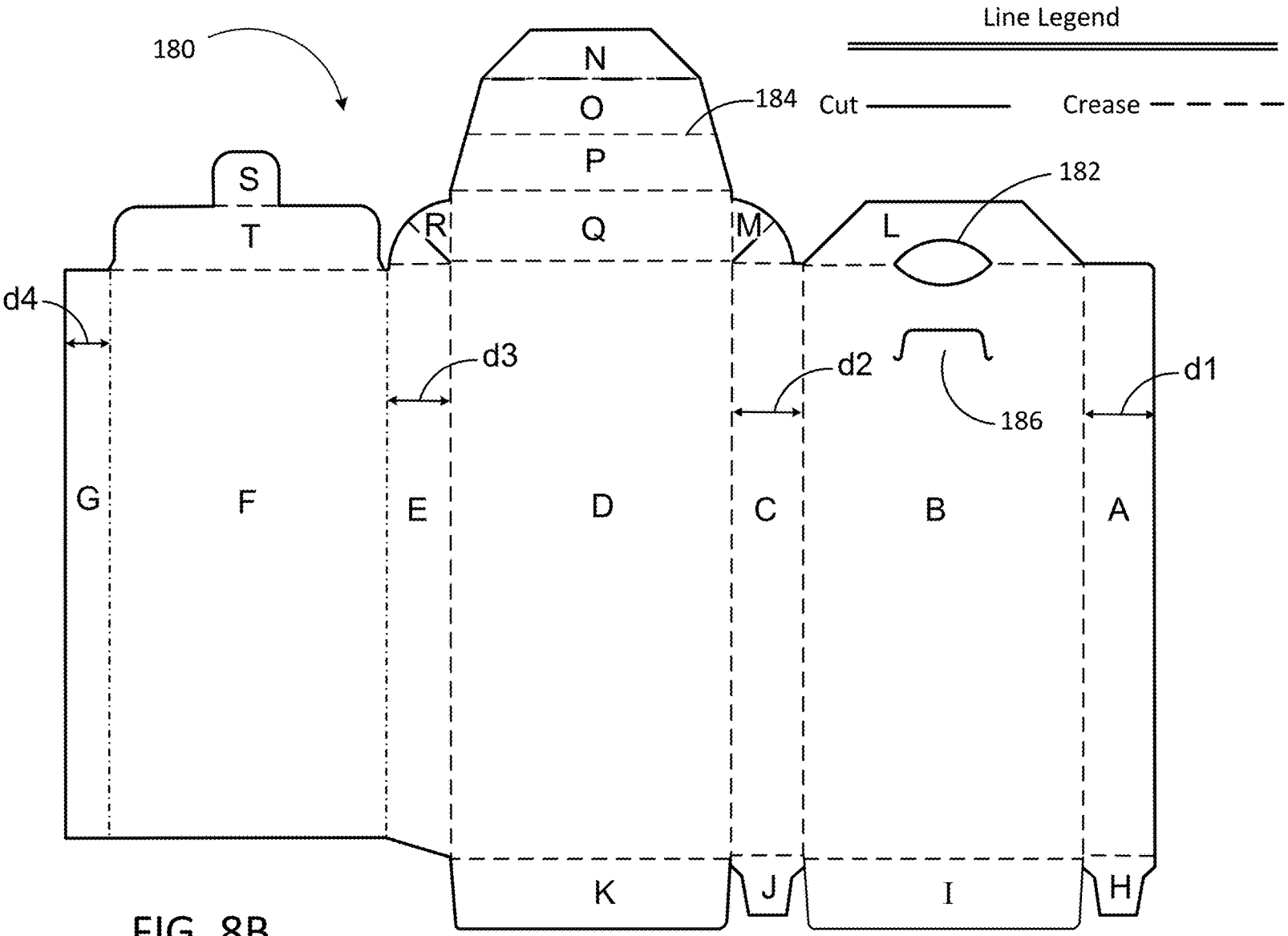

FIGS. 8A and 8B show the layout of the paperboard for a child resistant package 180 that is a variation of the package 100 of FIG. 1. The package 180 has a first end having an opening and a cover with a child resistant locking feature (similar to the package 100), and a second end having flaps that are glued together to form a sealed end. The package 180 uses web corners instead of the dust-flaps 124 and 126 of the package 100. The web corners add strength and make it more difficult for children to open the package 180.

In FIG. 8B, different parts of the paperboard have been labeled from "A" to "T." The portions A, B, C, and D form the sidewalls of the outer cell of the package 180 (similar to the outer cell 102 of the package 100), and the portions E, F, and G form the sidewalls of the inner cell of the package 180 (similar to the inner cell 116 of the package 100). The portions A, B, C, D, E, F, and G of the package 180 are similar to the panels 110, 104, 106, 108, 158, 150, and 156, respectively, of the package 100. During assembly of the package 180, the portion E is attached (e.g., glued or taped) to the inner wall of the portion A, and the portion G is attached (e.g., glued or taped) to the inner wall of the portion C.

The widths d1 and d2 of the portions A and C, respectively, define the height of the package 180. In this example, d1 is equal to d2 so that the outer shape of the package 180 resembles a rectangular box. The portion E has a width d3 that is slightly smaller than d1. The portion G has a width d4 that is slightly smaller than d2.

The portions E, F, and G of the package 180 define a first chamber, which is similar to the first chamber 152 of the package 100. The portions B and F, and a fraction of the portions A and C of the package 180 define a second chamber, which is similar to the second chamber 154 of the package 100.

The portions H and J of the package 180 are similar to the flaps 130 and 128, respectively, of the package 100. The portion I can be glued to the portion K to seal the second end of the package 180.

The portion L of the package 180 is similar to the inner locking tab 118 of the package 100. During assembly of the package 180, the portion Lis folded inwards and glued to the inner wall of the portion B.

The portions M and R of the package 180 form web corners and function similar to the end flaps 124 and 126, respectively, of the package 100. The portion Q of the package 180 is similar to the cover panel 138 of the package 100.

The portions O and P of the package 180 are similar to the extension 142 of the package 100. The portion N of the package 180 is similar to the tuck flap locking tab 144 of the package 100. A crease 184 is provided between the portions O and P to make it easier to tuck the portions O, P, and N into the second chamber of the package 180.

The portion T of the package 180 is similar to the cover panel 132 of the package 100. The portion S functions as a pull tab that makes it easier for the user to open the cover panel formed by the portion T. In this example, a cutout 182 is provided to form a notch at the first end of the portion B to make it easier for the user to pull the portion P out of the second chamber of the package 180.

In this example, the width d4 of the portion G is slightly smaller than the width d3 of the portion E so that the second chamber has one side that is slightly narrower than the other side. Making a first side (the side closer to the portion A) of the second chamber narrower ensures that the tuck flap locking tab formed by the portion N will engage the inner locking tab formed by the portion L when the package 180 is in the closed state. Making a second side (the side closer to the portion C) of the second chamber slightly taller makes it easier for the user to pull the tuck flap formed by the portions N, O, and P out of the second chamber.

The package 180 includes a release button 186 that is provided by forming a U-shaped cut in the portion B. The release button 186 in the package 180 functions in a similar manner as the release button 148 in the package 100.

Figure 9:
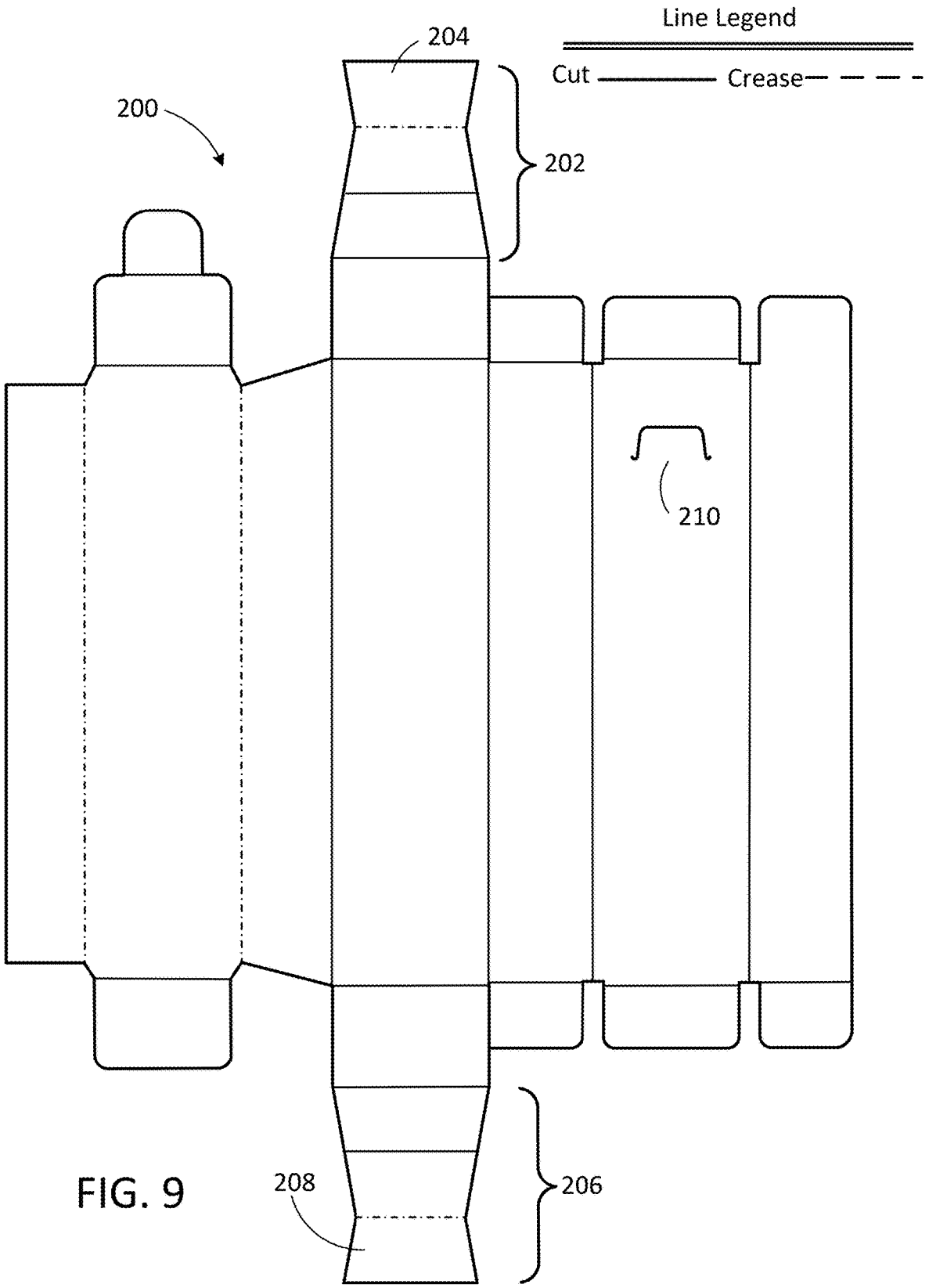
FIG. 9 is a diagram of another example of a layout for a child resistant paperboard package.

FIG. 9 shows the layout of the paperboard for another child resistant package 200 that operates in a manner similar to the package 100 of FIG. 1. The package 200 includes a first tuck flap 202 having a tuck flap locking member 204 at a first end, and a second tuck flap 206 having a tuck flap locking member 208 at a second end. A release button 210 is provided at the first end of the package 200. The package 200 includes a first chamber and a second chamber, similar to those of the package 100. After the first tuck flap 202 is fully inserted into the second chamber of the package 200, the user can press the release button 210 and pull the first tuck flap 202 out of the second chamber. The second end of the package 200 does not have a release button. Thus, after the second tuck flap 206 is fully inserted into the second chamber of the package 200, the second tuck flap 206 is locked in place and cannot be pulled out of the second chamber without significant effort.

The following describes another example of a child resistant, senior friendly package, container, or box that includes an outer sleeve or package and an inner sleeve or container. The inner sleeve or container includes a protruding locking tab that nests into a compatible recess on the outer sleeve or package such that they effectively form a locking mechanism preventing further extraction of the inner sleeve or container from the outer sleeve or package, thereby preventing access to the potentially hazardous contents of the inner sleeve or container by children or others who should not have access to the hazardous contents.

The engaged locking mechanism can be disengaged by depressing a specified location on the outer sleeve or package, which will disengage the inner protruding tab on the inner sleeve or container from the compatible recess on the outer sleeve or package, effectively unlocking the locking mechanism, allowing the inner sleeve or container to be slid open from the outer sleeve or package. One end of the outer sleeve or package is tightly sealed such that the inner sleeve or container can only be opened in one direction to access the potentially hazardous contents. Further embodiments may include multiple locking mechanisms on the inner sleeve or container, on the two sides for example, and additional locking mechanisms may prevent the inner sleeve or container from being completely removed from the outer sleeve or package.

FIGS. 10A to 10H and 11 show images of an example of a recyclable child resistant paperboard package 220 that includes an outer sleeve 222 and an inner tray 224. The sleeve 222 and tray 224 are also referred to as the "outer cell" and "inner cell," respectively. The sleeve 222 defines a partial enclosure or chamber 280 having a front opening 282, and the tray 224 can slide in and out of the enclosure or chamber 280 through the front opening 282. The package 220 has a locking mechanism for locking the tray 224 in the sleeve 222 in a manner that is child resistant and senior friendly.

Figure 10A:
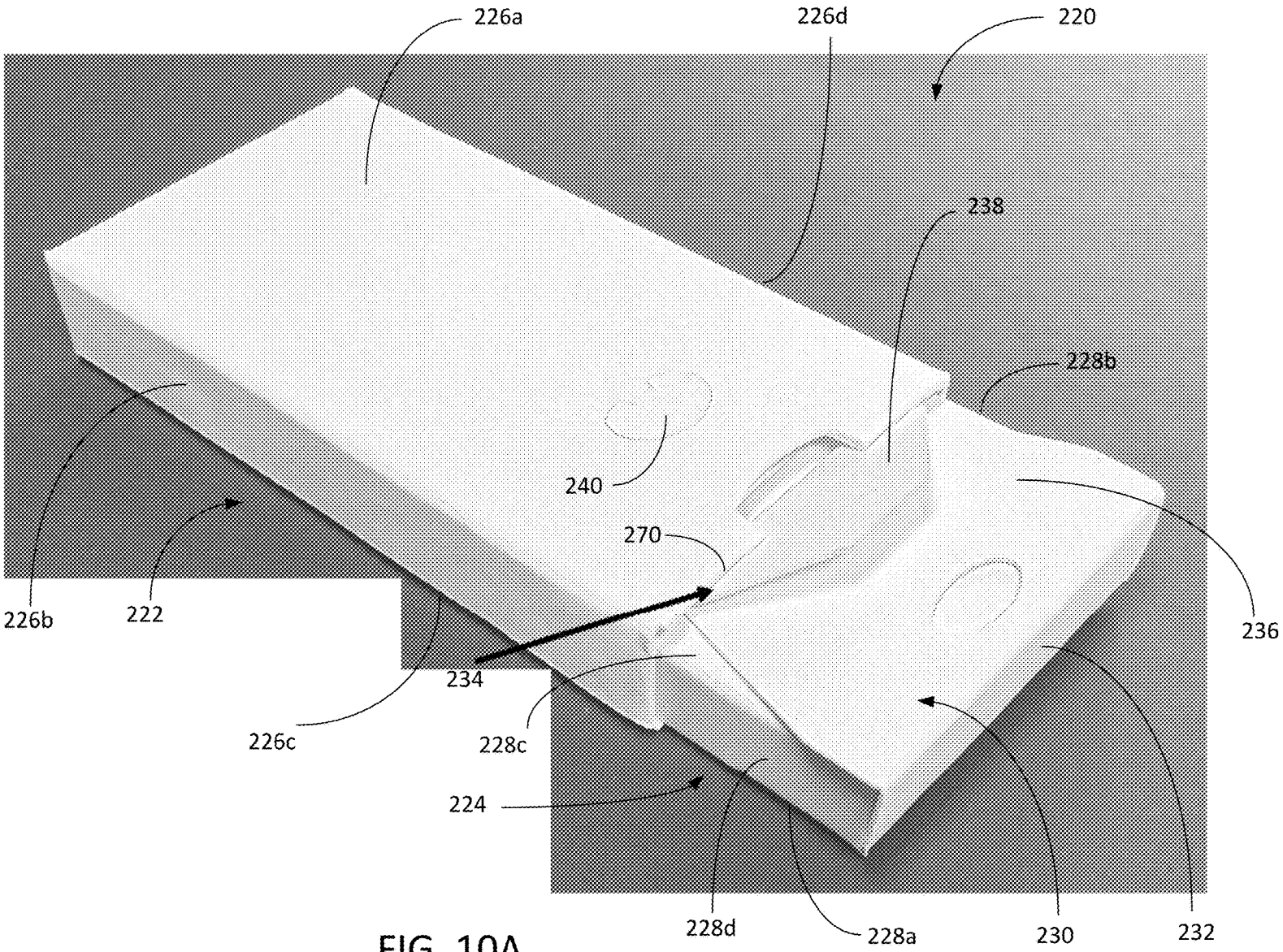
FIGS. 10A to 10C are images of an example of a child resistant paperboard package that includes a sleeve and a tray with an integrated tuck locking flap.
Figure 10B:
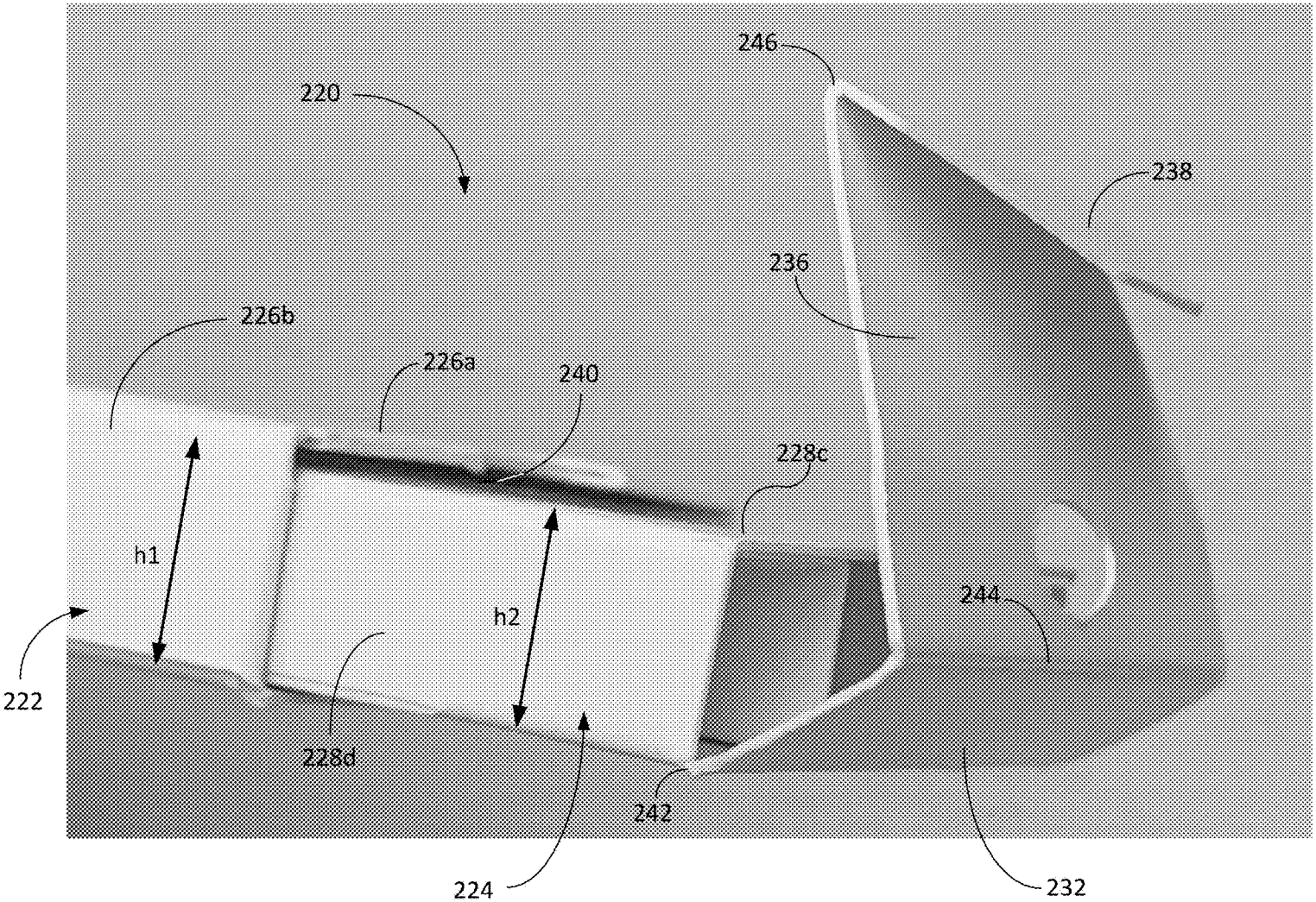
Figure 10C:
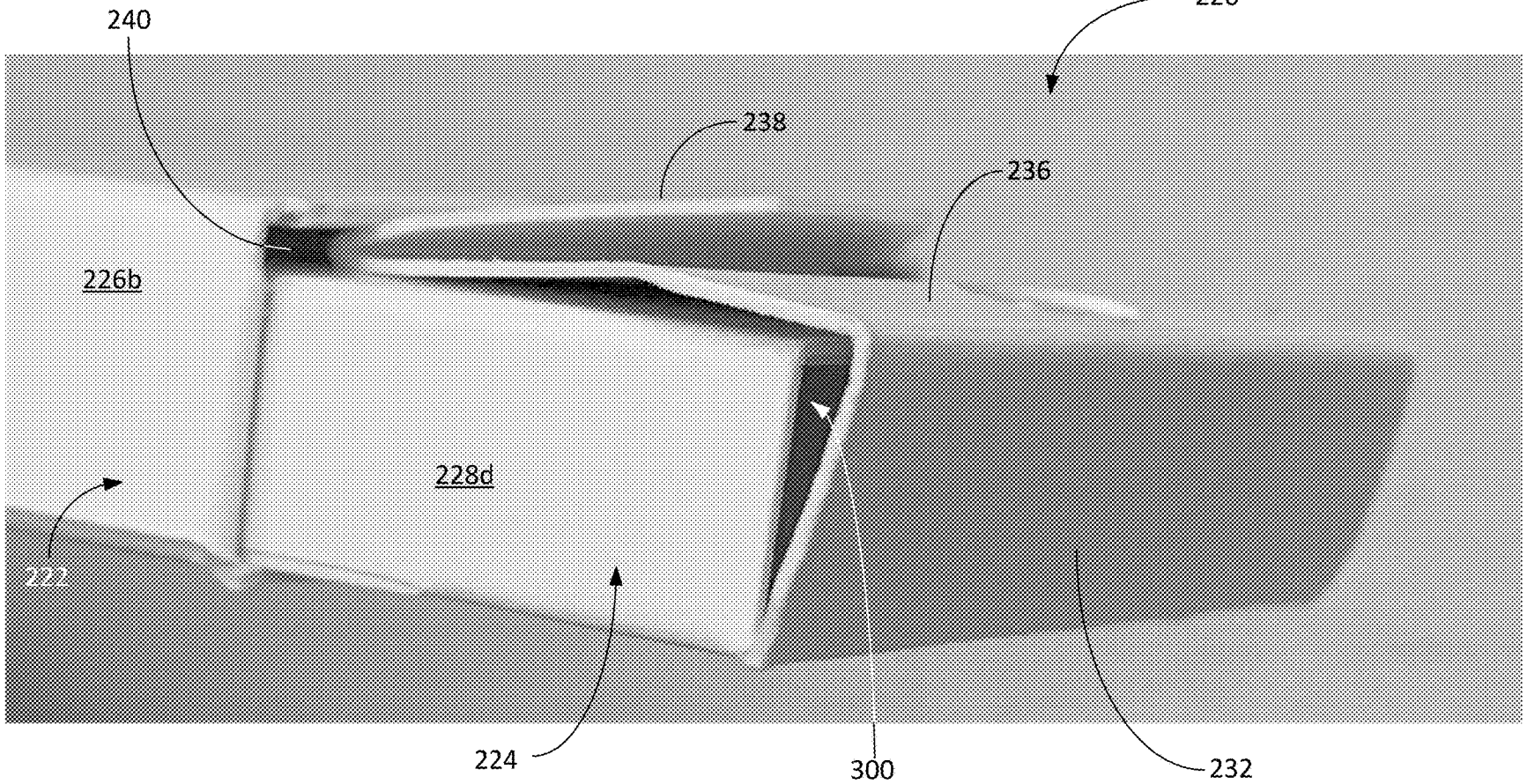
Figure 10D:
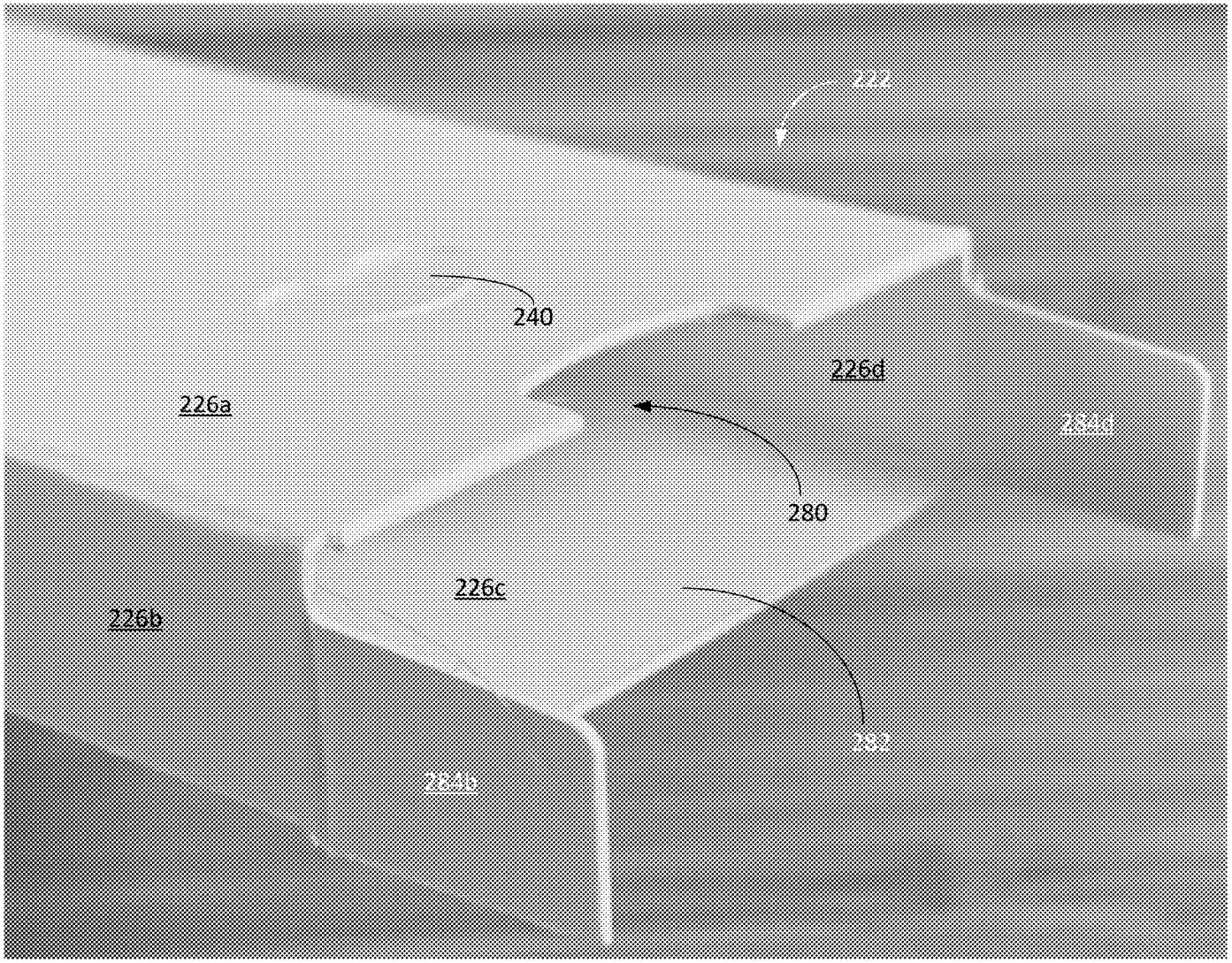
FIGS. 10D to 10F are images of the sleeve.
Figure 10E:
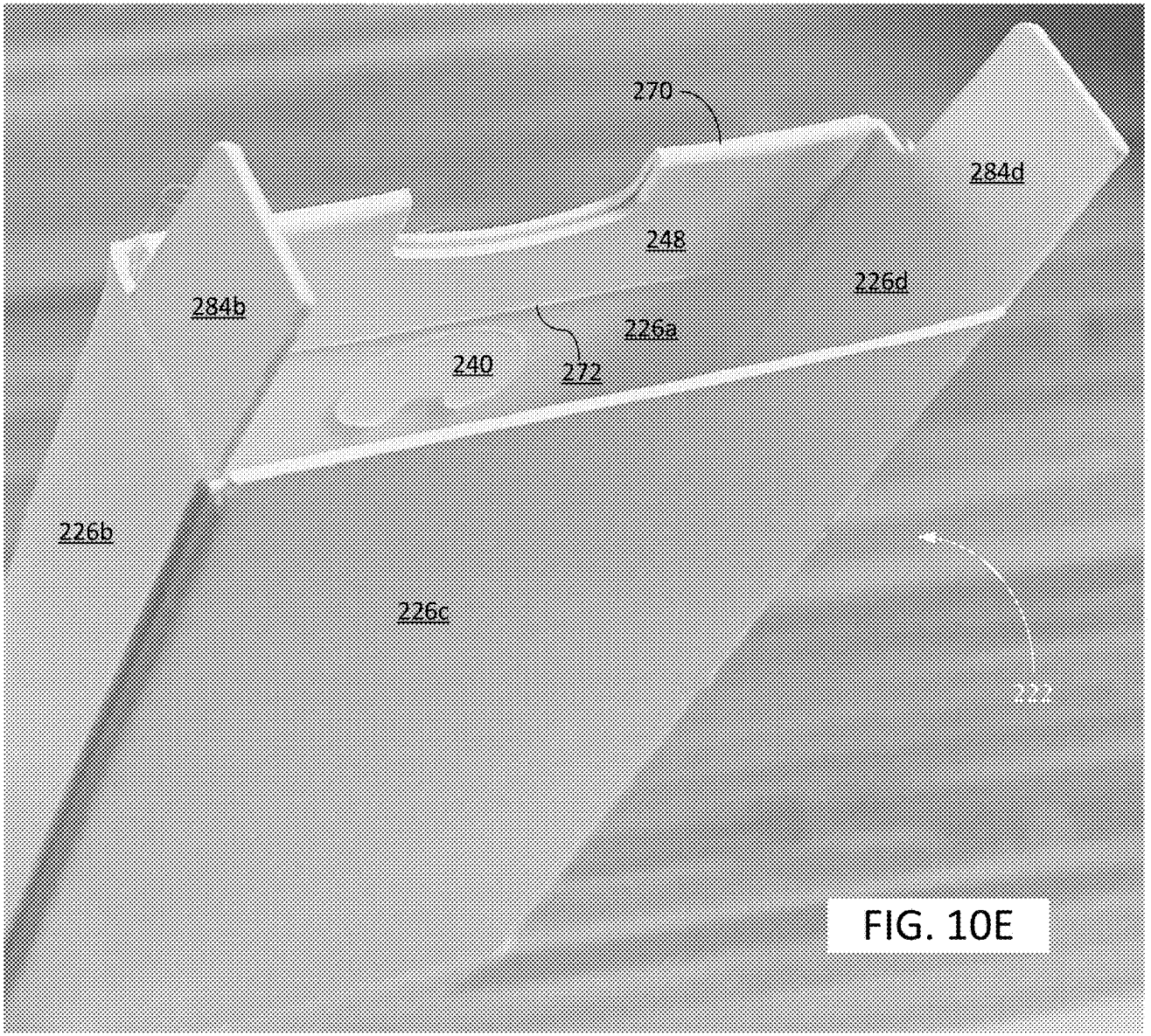
Figure 10F:
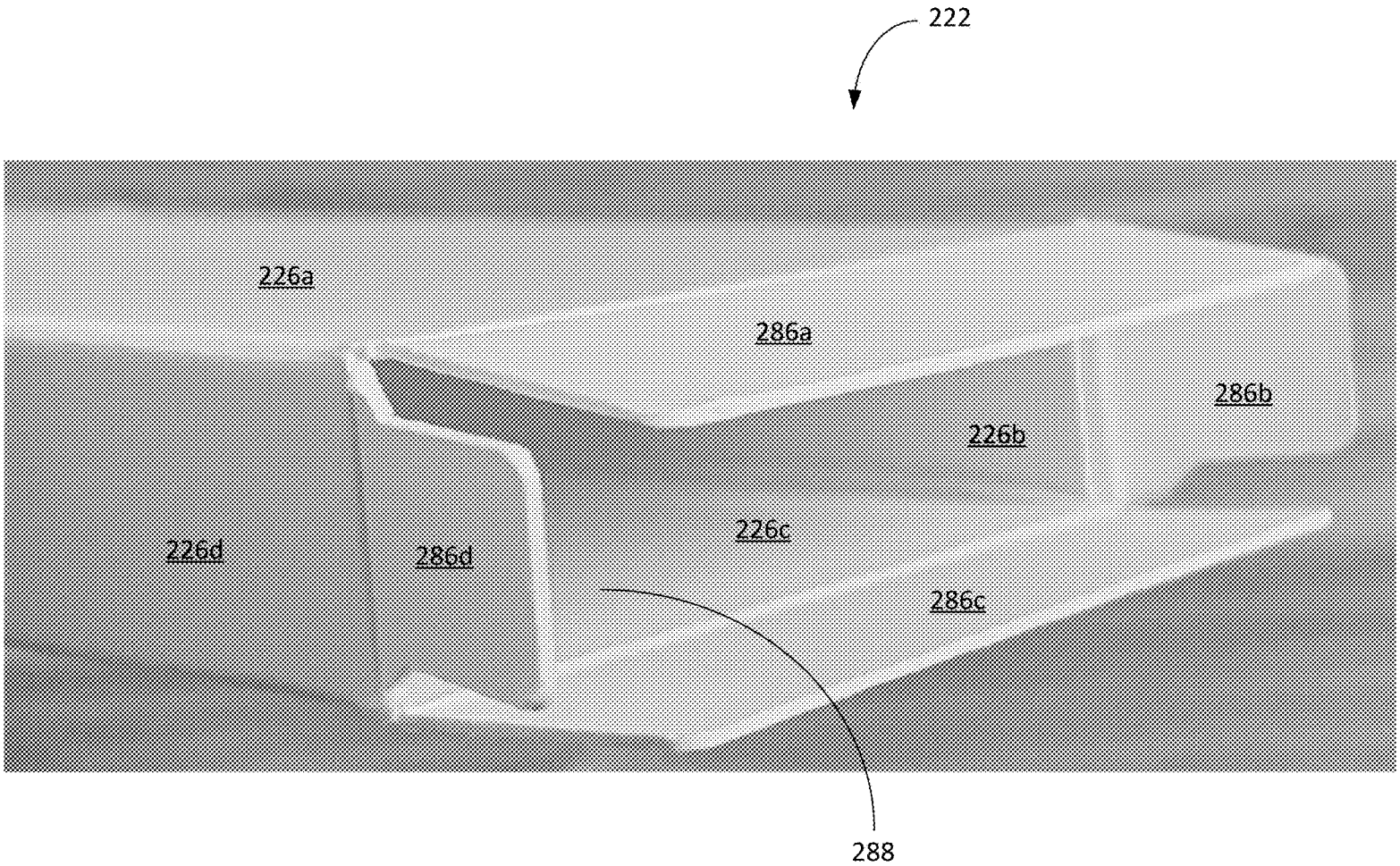
Figure 10G:
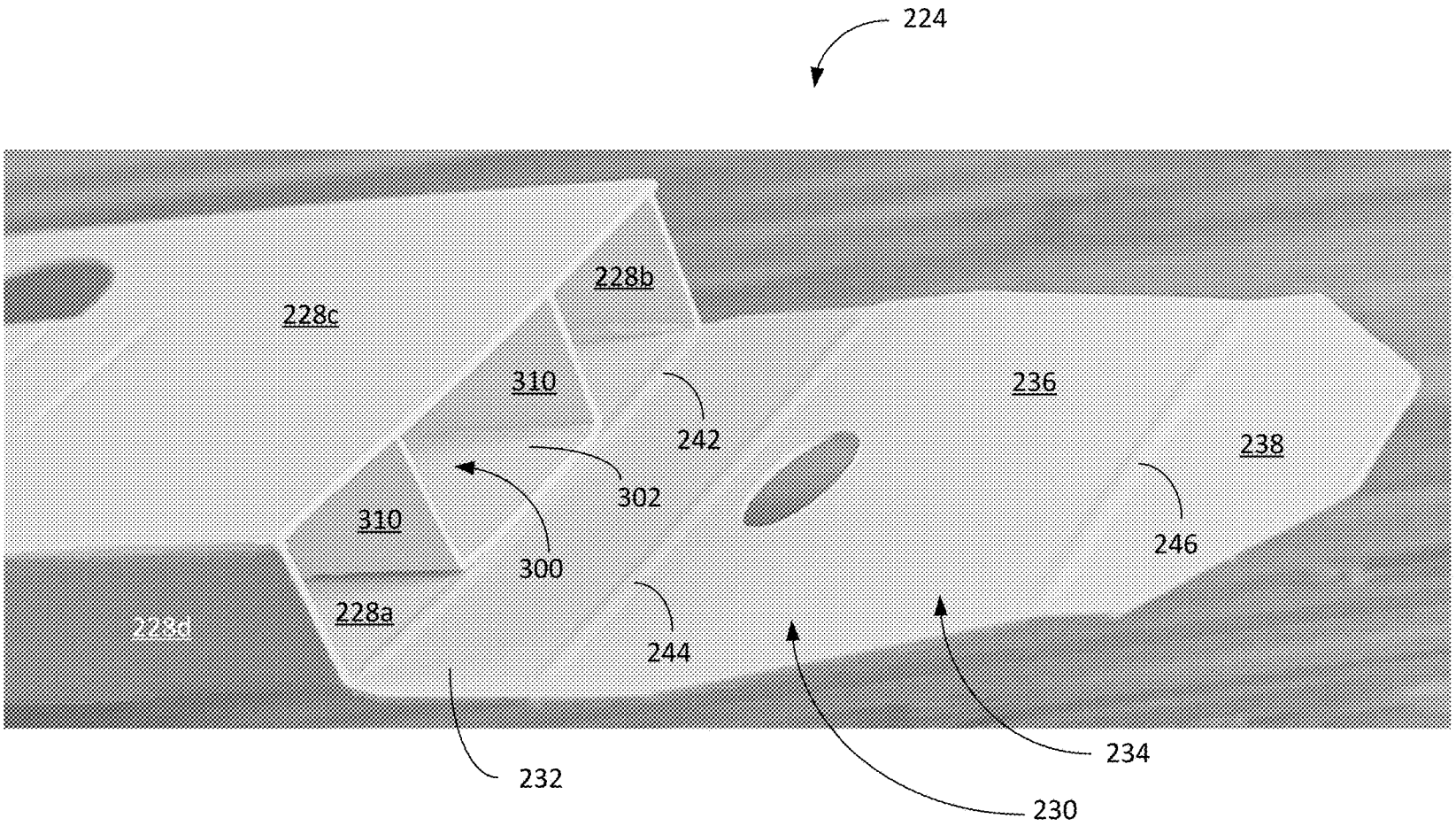
FIGS. 10G and 10H are images of the tray.
Figure 10H:
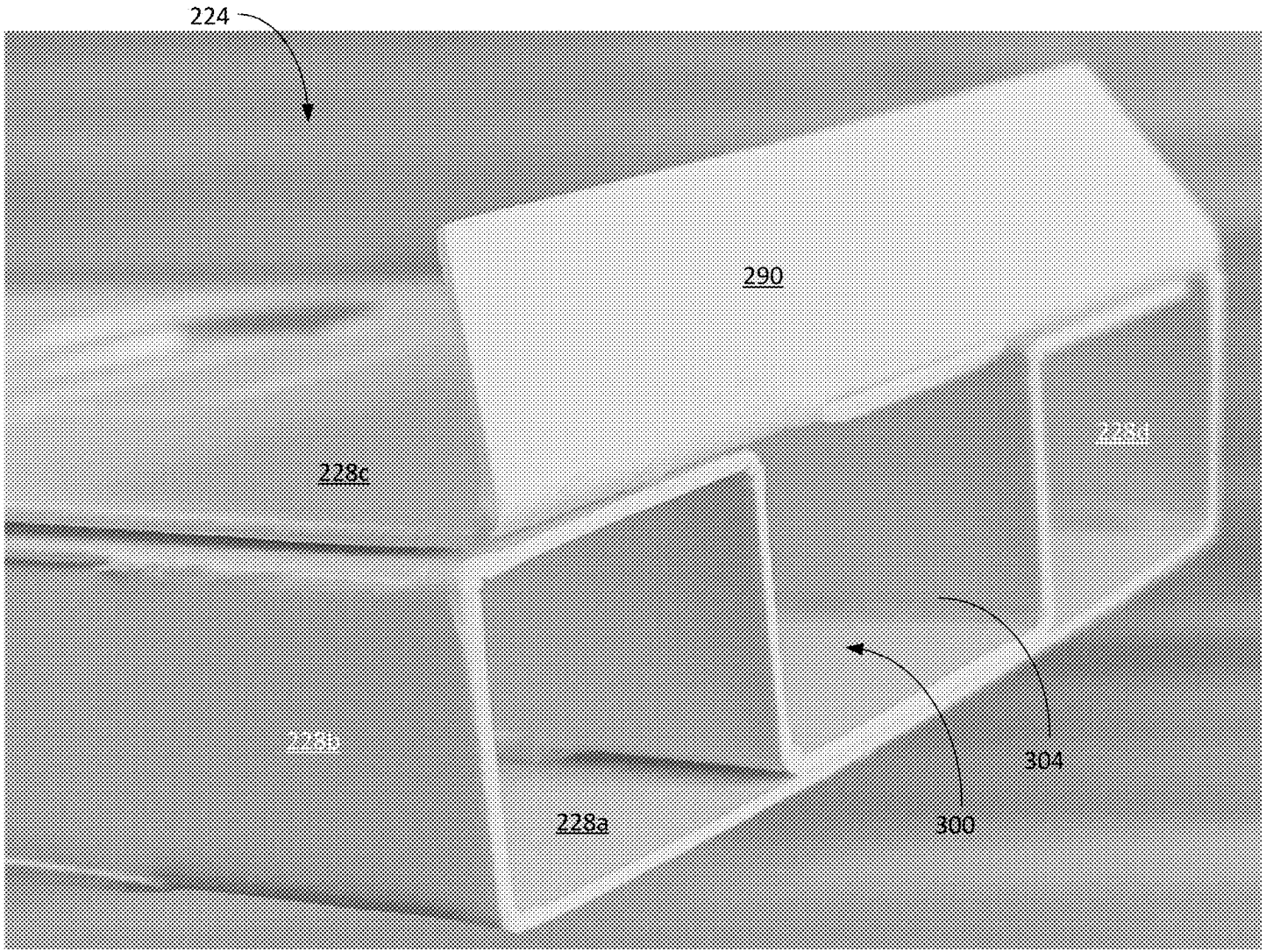
Figure 11:
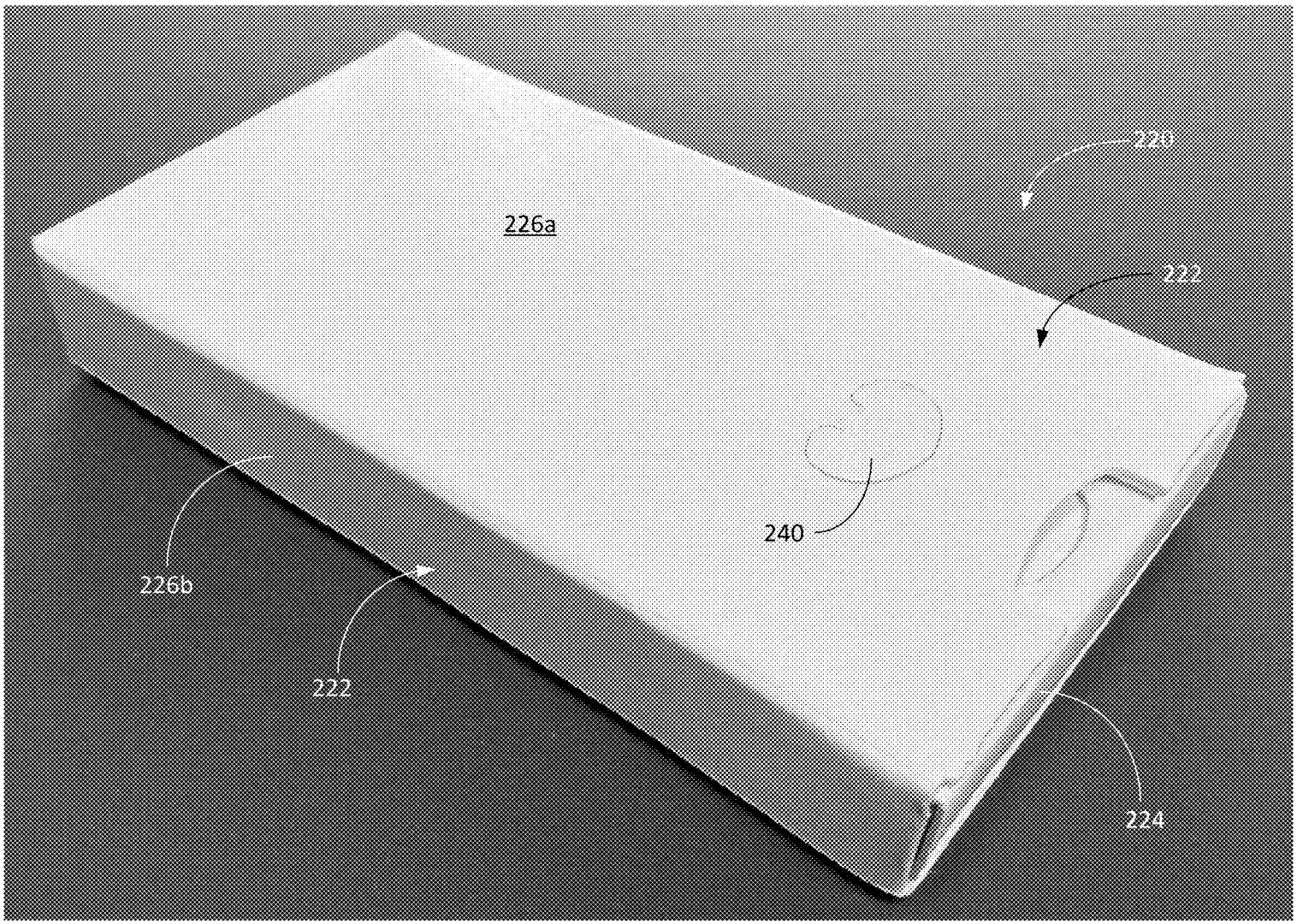
FIG. 11 is a perspective view of an example of the child resistant paperboard package with the tray inserted into the sleeve.

FIGS. 10A to 10C show perspective views of the child resistant paperboard package 220 with the tray 224 extending partially out of the sleeve 222 with an extension panel 230 at various positions. FIGS. 10D and 10E show the front perspective views of the partially assembled sleeve 222. FIG. 10F show the rear perspective view of the partially assembled sleeve 222. FIG. 10G is a front perspective view of the tray 224. FIG. 10H is a rear perspective view of the tray 224. FIG. 11 is a perspective view of the child resistant paperboard package 220 with the tray 224 fully inserted into the sleeve 222.

The sleeve 222 include a first set of side panels 226 and an inner locking member or tab 248. The first set of side panels 226 includes a first side panel 226*a* (facing the top side in FIG. 10A), a second side panel 226*b* (facing the left side in FIG. 10A), a third side panel 226*c* (facing the bottom side and obscured from view in FIG. 10A, visible in FIGS. 10D to 10F), and a fourth side panel 226*d* (facing the right side and obscured from view in FIG. 10A, visible in FIGS. 10D to 10F), collectively referenced as 226. The first side panel 226*a* is opposite of the third side panel 226*c*. The second side panel 226*b* is opposite of the fourth side panel 226*d*. The side panels 226 define a first partial enclosure or chamber 280, a front opening 282 (see FIG. 10D), and a rear opening 288 (see FIG. 10F). The package 220 is configured such that the tray 224 can slide in and out of the first partial enclosure or chamber 280 through the front opening 282.

The first end of the sleeve 222 near the front opening 282 is referred to as the front end of the sleeve 222. The second end of the sleeve 222 opposite the first end is referred to as the rear end of the sleeve 222.

Referring to FIGS. 10D and 10E, a first front end flap (or dust flap) 284*b* is coupled to the front end of the side panel 226*b*, and a second front end flap (or dust flap) 284*d* is coupled to the front end of the side panel 226*d*. When the package 220 is fully assembled, the first end flap 284*a* and the second end flap 284*b* are folded inward and positioned adjacent to the inner walls of the side panels 226*b* and 226*d*, respectively.

The inner locking tab 248 is attached to the inner wall of the side panel 226*a*. In some implementations, the inner locking tab 248 is coupled to the front end 270 of the first side panel 226*a*, folded inwards, and attached to the inner wall of the first side panel 226*a*. For example, the inner locking tab 248 and the first side panel 226*a* can be formed by a continuous sheet of material (e.g., paperboard), and the inner locking tab 248 is formed by folding a portion of the continuous sheet of material inwards. The inner locking tab 248 has an edge 272 that faces towards the rear end of the sleeve 222. The inner locking tab 248 is part of a locking mechanism for preventing the tray 224 from sliding out of the sleeve 222 when the package 220 is in a closed or locked state. The inner locking member 248 (see FIG. 10E) of the sleeve 222 can be similar to the inner locking tab 118 of the package 100 (see FIG. 7). The package 220 includes a release member for disengaging the locking mechanism. In this example, a release tab 240 is provided on the side panel 226*a*.

Referring to FIG. 10F, a first rear end flap 286*a* is coupled to a rear end of the side panel 226*a*, a second rear end flap (or dust flap) 286*b* is coupled to a rear end of the side panel 226*b*, a third rear end flap 286*c* is coupled to a rear end of the side panel 226*c*, and a fourth rear end flap (or dust flap) 286*d* is coupled to a rear end of the side panel 226*d*. When fully assembled, the rear end flaps 286*a*, 286*b*, 286*c*, and 286*d* are folded inward, with the rear end flaps 286*a* and 286*c* glued together, thereby forming a closed rear end of the sleeve 222.

Figure 16A:
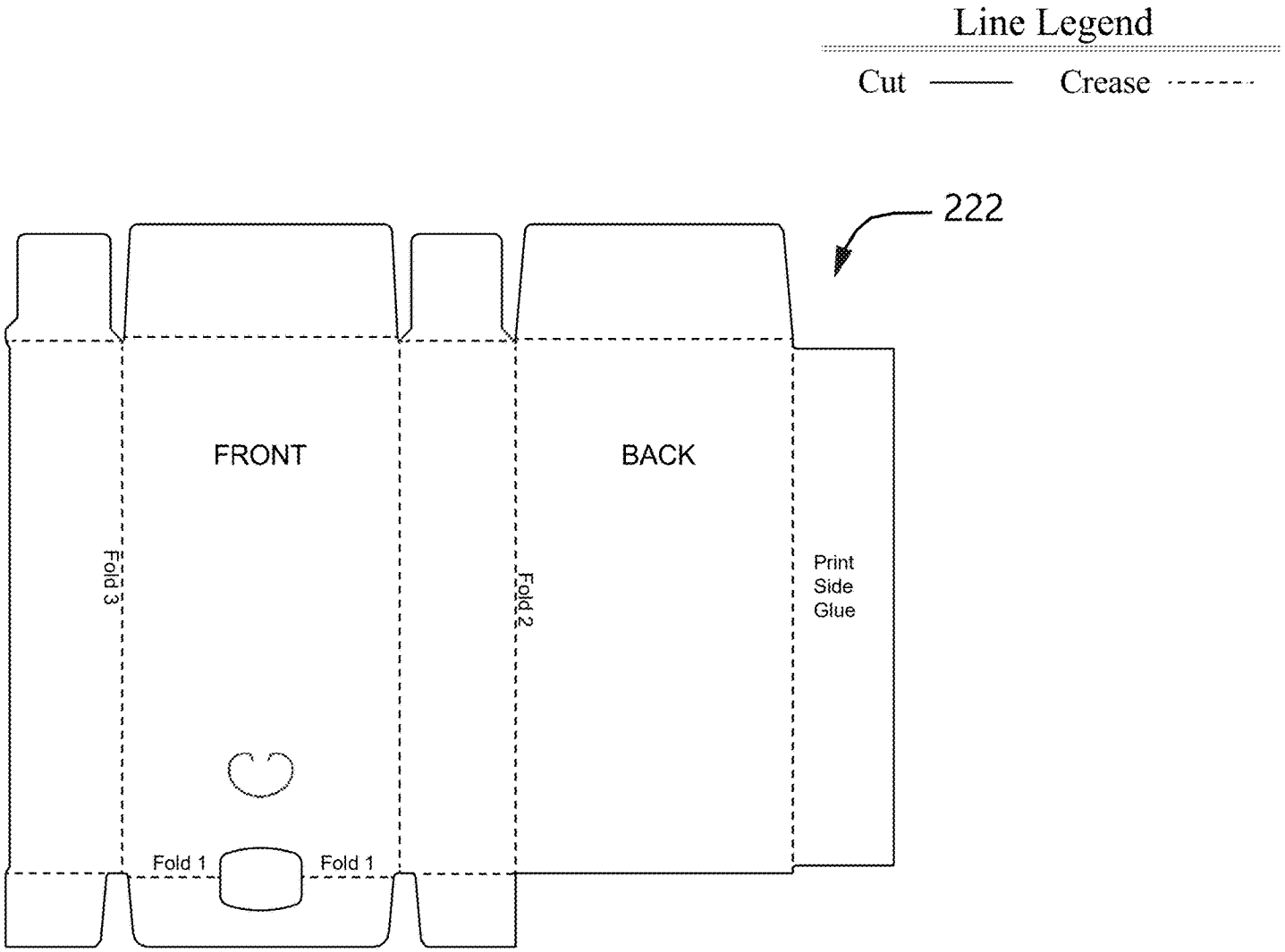
FIGS. 16A and 16B show an example of the paperboard layout for a sleeve of a child resistant package.
Figure 16B:
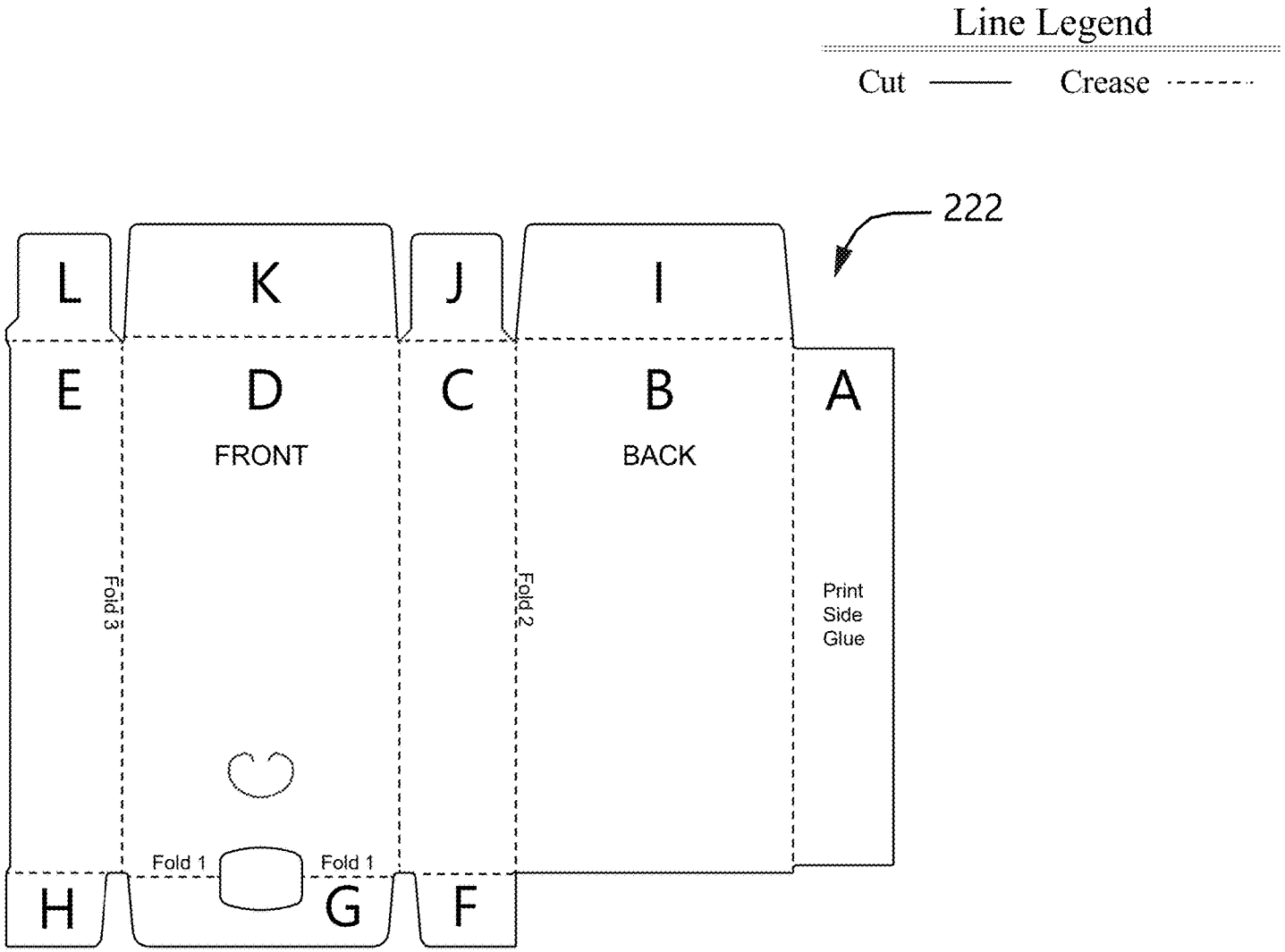

FIG. 16B is a diagram showing a layout of the sleeve 222. The side panels 226*a*, 226*b*, 226*c*, and 226*d* correspond to the side panels D, E, B, and C, respectively, in FIG. 16B. The inner locking tab 248 corresponds to tab G in FIG. 16B. The front end flaps 284*b* and 284*d* correspond to front end tabs H and F, respectively, in FIG. 16B. The rear end flaps 286*a*, 286*b*, 286*c*, and 286*d* correspond to rear end tabs K, L, I, and J, respectively, in FIG. 16B.

Referring to FIGS. 10A to 10C, 10G, and 10H, the tray 224 includes a second set of side panels 228, an extension panel 230, and a rear tuck flap 290. The side panels 228 include a first side panel 228*a* (facing the bottom side and obscured from view in FIG. 10A, visible in FIGS. 10G and 10H), a second side panel 228*b* (facing the right side and obscured from view in FIG. 10A, visible in FIGS. 10G and 10H), a third side panel 228*c* (facing the top side in FIG. 10A), and a fourth side panel 228*d* (facing the left side in FIG. 10A), collectively referenced as 228. The first side panel 228*a* is opposite of the third side panel 228*c*. The second side panel 228*b* is opposite of the fourth side panel 228*d*. The side panels 228 define a second enclosure or chamber 300, a front opening 302, and a rear opening 304. The second enclosure or chamber 300 can be used for storing items, such as medicine pills. The dimensions of the tray 224 are designed such that the tray 224 can be fully inserted into the first partial enclosure or chamber 280 of the sleeve 222 through the front opening 282. The extension panel 230 is connected to the side panel 228*a*. The extension panel 230 includes a cover panel 232 and a tuck flap 234. The tuck flap 234 includes an extension member 236 and a tuck flap locking member (or tab) 238.

The tray 222 can include support members 310 that maintain the distance between the side panel 228*a* and the side panel 228*c*. When the tray 224 is inserted into the sleeve 222, and the tuck flap locking tab 238 and a portion of the extension member 236 is tucked into the gap 240 between the tray 224 and the sleeve 222, the tuck flap locking tab 238 and the extension member 236 pushes against the side panel 228*c* of the tray 224. The support members 310 prevents the side panel 228*c* from bending so that the width of the gap 240 can be maintained relatively constant. This allows the tuck flap locking tab 238 to maintain its position and engage the inner locking tab 248 when a person attempts to pull the tray 224 out of the sleeve 222.

The package 220 can be closed and locked using the following steps. The cover panel 232 and the tuck flap 234 are folded inward to cover the front opening 302. The tuck flap locking tab 238 is folded outwards. The tray 224 is inserted into the sleeve 222, with the tuck flap locking tab 238 and a portion of the extension member 236 inserted into a gap between the side panel 228*c* of the tray 224 and the side panel 226*a* of the sleeve 222 (see FIGS. 10B, 10C, and 14A to 14C).

Referring to FIGS. 10B and 10C, the height h1 of the inner wall of the side panels 226*b* and 226*d* of the sleeve 222 is slightly larger than the height h2 of the outer wall of the side panels 228*d* and 228*b*, thus forming a narrow gap 240 between the sleeve 222 and the tray 224. The gap 240 is between the outer wall of the side panel 228*c* of the tray 224 and the inner wall of the side panel 226*a* of the sleeve 222. The gap 240 can be, e.g., about 1/32 to 1/16 of an inch.

A user can close and lock the package 220 by folding back the tuck flap locking tab 238 in a triple fold, then pushing the tray 224 into the sleeve 222, and tucking the tuck flap locking tab 238 and a portion of the extension member 236 into the gap 240 between the sleeve 222 and the tray 224. The "triple fold" refers to the three folds used to form the cover panel 232, the extension member 236, and the tuck flap locking tab 238. The three folds include an inner fold 242, an inner fold 244, and a third outer fold 246 (also see FIG. 10G).

FIG. 11 shows an example of the child resistant paperboard package 220 in which the tray 224 is fully inserted into the sleeve 222. The dimensions of the extension member 236 and the tuck flap locking tab 238 are selected such that when the tray 224 is fully inserted into the sleeve 222, the tuck flap locking tab 238 slides past the inner locking member 248. When a person attempts to pull the tray 224 out of the sleeve 222, the tuck flap locking tab 238 engages the inner locking member 248. The edge of the tuck flap locking tab 238 engages the edge of the inner locking member 248, thereby preventing the tray 224 from being pulled out of the sleeve 222. In this configuration, the package 220 is in a closed or locked state.

The user can press the release member 240 to disengage the tuck flap locking tab 238 from the inner locking member 248, thereby allowing the tray 224 to be pulled and partially extend out of the first chamber of the sleeve 222. In this configuration, the package 220 is in an open or unlocked state. The function of the release member 240 is similar to that of the release button 148 of the package 100 (see FIG. 1).

In some examples, prior to inserting the tray 224 into the sleeve 222, the user can lay the extension member 236 and the tuck flap locking tab 238 flat. In this configuration, after the tray 224 is fully inserted into the sleeve 222, when a person pulls the tray 224, the tuck flap locking tab 238 does not engage the inner locking tab 248, so the tray 224 can be pulled out of the sleeve 222 without the need to first press the release button 240. This can be useful when there is no risk that a child will pull the tray 224 out of the sleeve 222 and obtain the contents in the tray 224.

In some examples, the tray 224 has a rear tuck flap 290 (see FIG. 10H). When the tray 224 is pulled from the sleeve 222 to a certain extent, the rear tuck flap 290 engages the inner locking member 248, preventing the tray 224 from being completely pulled out of the sleeve 222. In some examples, the rear tuck flap 290 is much wider than the release tab 240. Pressing the release tab 240 may press down the center portion of the rear tuck flap 290 and cause the center portion of the rear tuck flap 290 to disengage from the inner locking member 248. However, the left and right portions of the rear tuck flap 290 continue to engage the inner locking member 248 and prevent the tray 224 from being completely pulled out of the sleeve 222, even when the release tab 240 is pressed.

In some examples, the rear tuck flap 290 can have an edge with a width that is comparable to that of the tuck flap locking tab 238. When the tray 224 is pulled from the sleeve 222 to a certain extent, the rear tuck flap 290 engages the inner locking member 248. The user can press the release tab 240 to disengage the rear tuck flap 290 from the inner locking member 248, allowing the tray 224 to be fully pulled out of the sleeve 222.

Figures 12A, 12B, 12C:
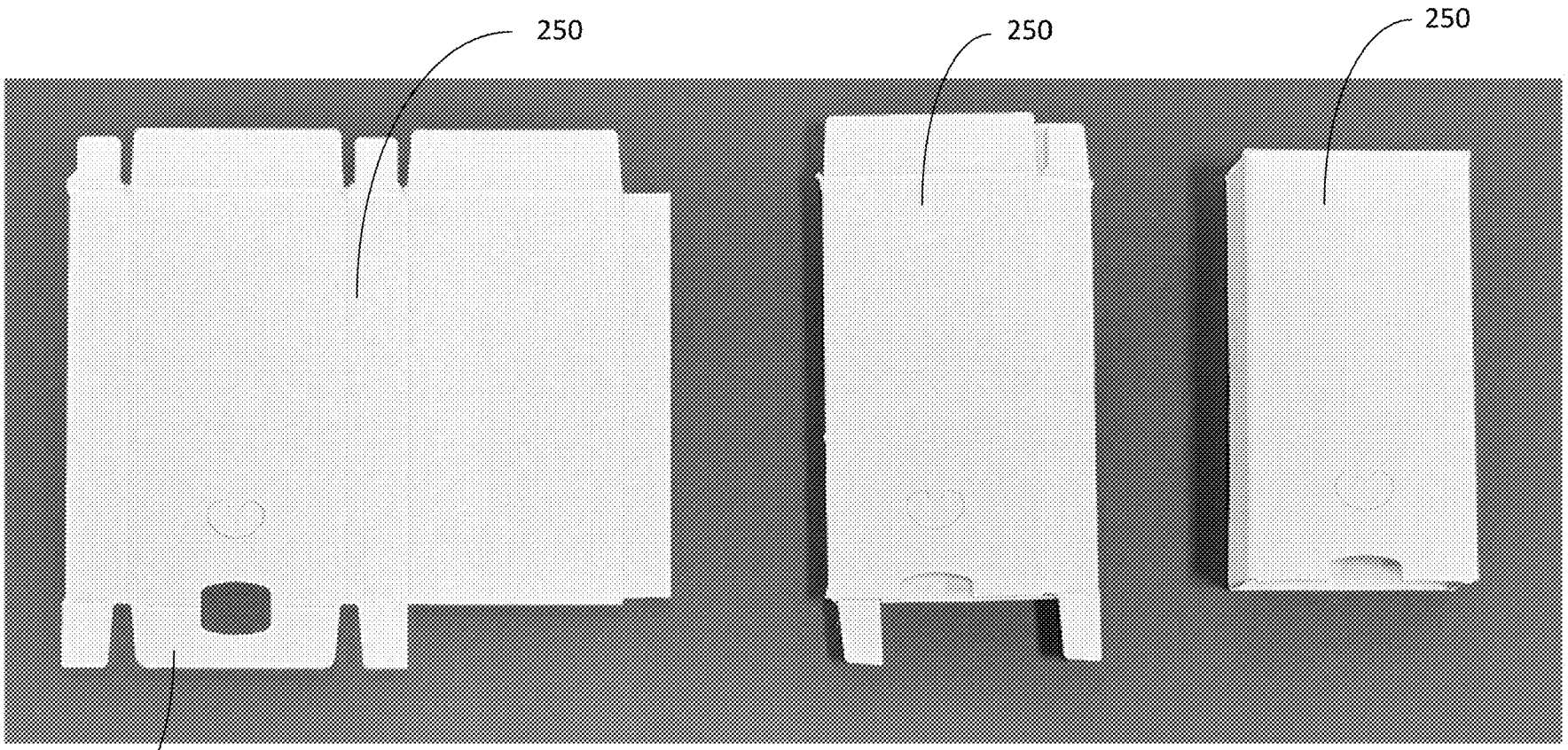
FIGS. 12A to 12C are diagrams of an example of a paperboard sleeve in various stages of assembly.

FIG. 12A shows an image of an example of a paperboard 250 for a sleeve 222 of a child resistant package 220. The paperboard 250 can be folded to form the side panels 226, the inner locking tab 248, and the end flaps.

FIG. 12B shows the paperboard 250 with portions glued together while the sleeve 222 remains in a flat configuration.

FIG. 12C shows the paperboard 250 for the sleeve 222 in an erected configuration, in which the side panels form walls of the first chamber.

Figures 13A, 13B, 13C:
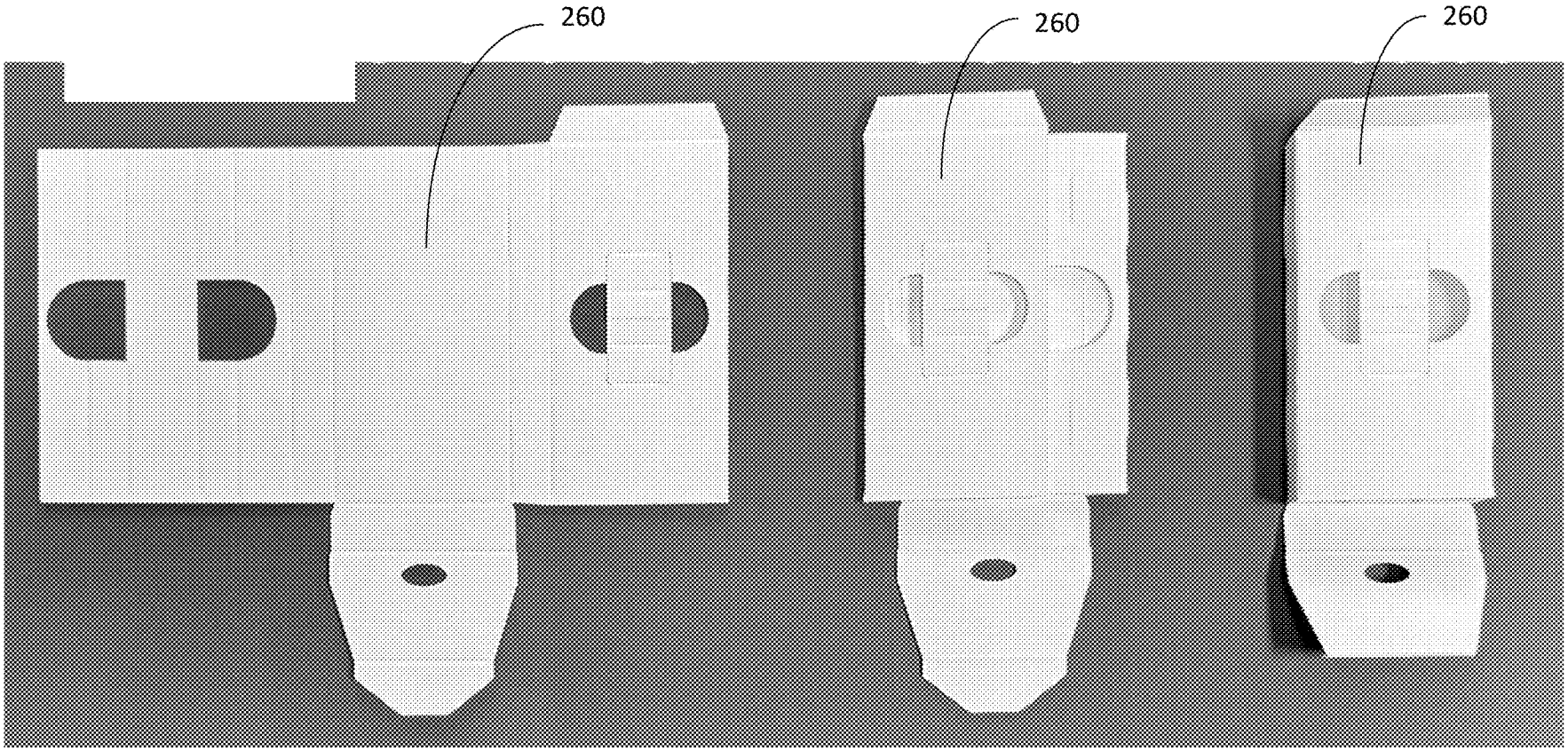
FIGS. 13A to 13C are diagrams of an example of a paperboard tray in various stages of assembly.

FIG. 13A shows an image of an example of a paperboard 260 for a tray 224 of a child resistant package 220. The paperboard 260 can be folded to form the side panels, the cover flap, and the tuck flap.

FIG. 13B shows the paperboard 260 for the tray 224 with portions glued together while the tray 224 remains in a flat configuration.

FIG. 13C shows the paperboard 260 for the tray 224 in an erected configuration, in which the side panels form walls of the second chamber and define the second opening.

Figure 14A:
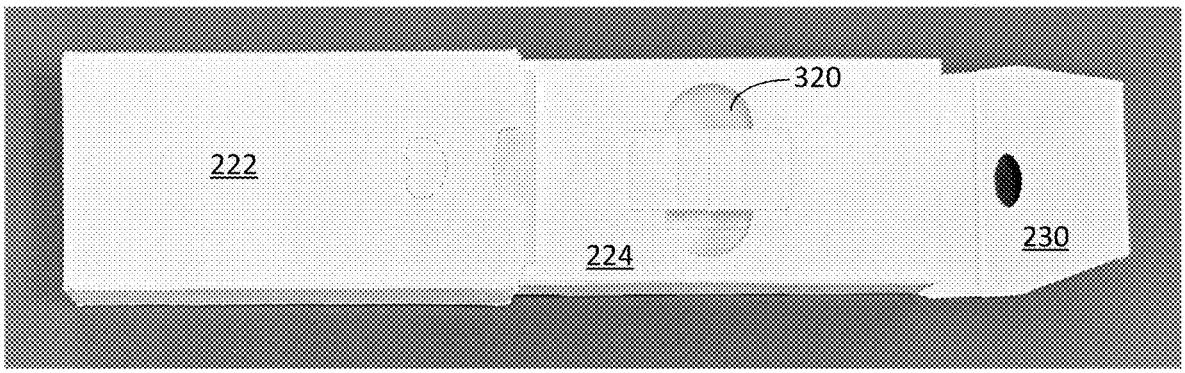
FIGS. 14A to 14C are diagrams showing a progression of the tray being inserted into the sleeve.
Figure 14B:
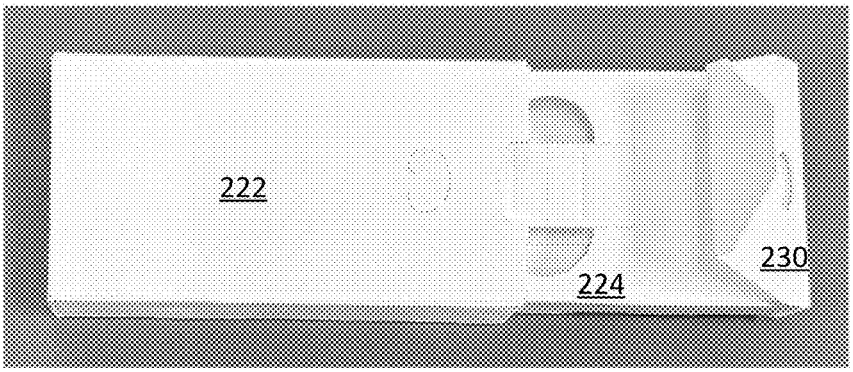
Figure 14C:
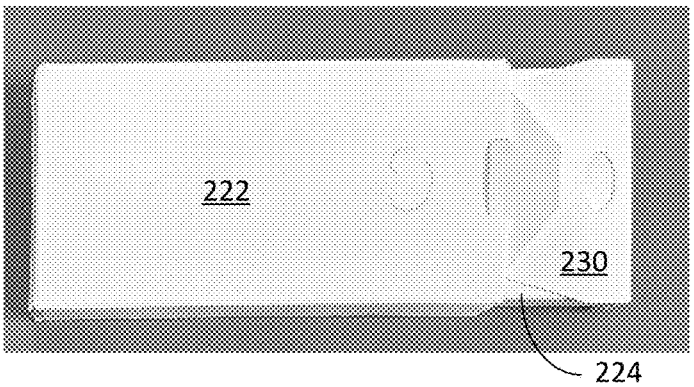

FIGS. 14A to 14C show an example of a progression of the tray 224 inserting into the sleeve 222. In FIG. 14A, a small portion of the tray 224 is inserted into the sleeve 222. In FIG. 14B, about half of the tray 224 is inserted into the sleeve 222. In FIG. 14C, the tuck flap locking tab and a portion of the extension member are about to be tucked into the gap between the sleeve and the tray.

As shown in FIG. 14A, in some implementations, the side panel 228*c* can have cut-outs that form an opening 320 to allow the user to place items in the tray 224 from the top side.

Figure 15:
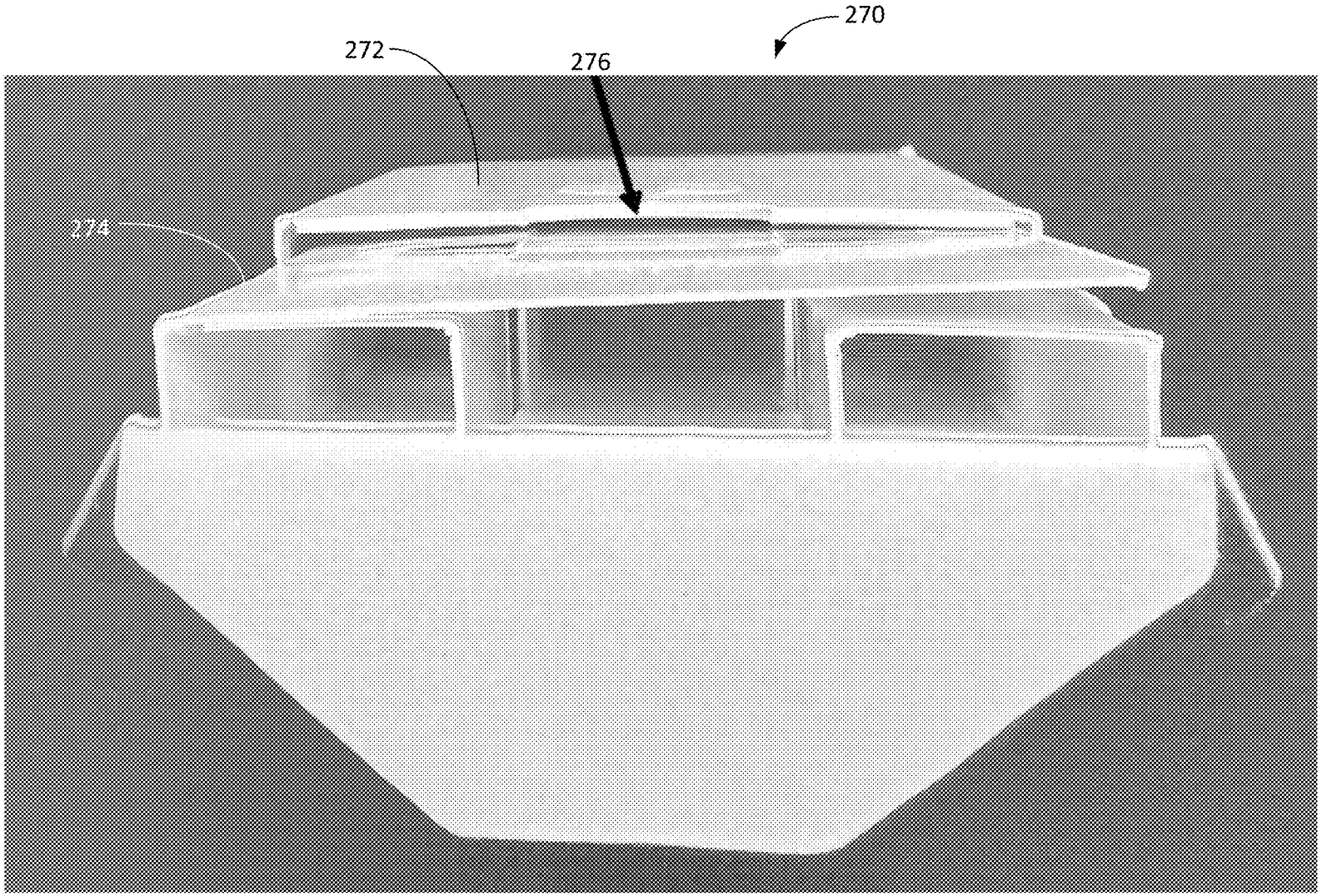
FIG. 15 is a diagram showing a child resistant paperboard package with a tray being inserted into a sleeve as viewed from the front side.

FIG. 15 is an image of an example of a child resistant paperboard package 270 that includes a sleeve 272 and a tray 274, in which the tray 274 is partially inserted into the sleeve 272. The tray is sized to generate a cavity or gap 276 that accepts the tuck flap locking tab of the tray 274.

FIGS. 16A and 16B show an example of the layout of the paperboard for a sleeve 222 of a child resistant package 220. The sleeve 222 has a front end having an opening with an inner locking tab, and a rear end having flaps that are glued together to form a sealed end. The sleeve 222 uses dust-flaps at the front end.

In FIG. 16B, different parts of the paperboard have been labeled from "A" to "L." The portions A, B, C, D, and E form the sidewalls of the sleeve 222. The portions B, C, D, and E of the sleeve 222 correspond to the side panels 226*c*, 226*d*, 226*a*, and 226*b*, respectively, in FIG. 10A. Near the front end of the sleeve 222, the portion G corresponds to the inner locking tab 248. The portions F and H correspond to the end tabs 284*d* and 284*b*, respectively, which are dust flaps for the front opening 282 of the sleeve 222. Near the rear end, the portions I, J, K, and L correspond to the rear end flaps 286*c*, 286*d*, 286*a*, and 286*b*, respectively. The portions I and K are glued together to form a sealed end. The portions J and L are dust flaps for the rear opening. During assembly of the sleeve 222, the portion A is attached (e.g., glued or taped) to the inner wall of the portion E, and the portion G is attached (e.g., glued or taped) to the inner wall of the portion D. The portion I is attached (e.g., glued or taped) to the portion K to form a sealed end.

Figure 17A:
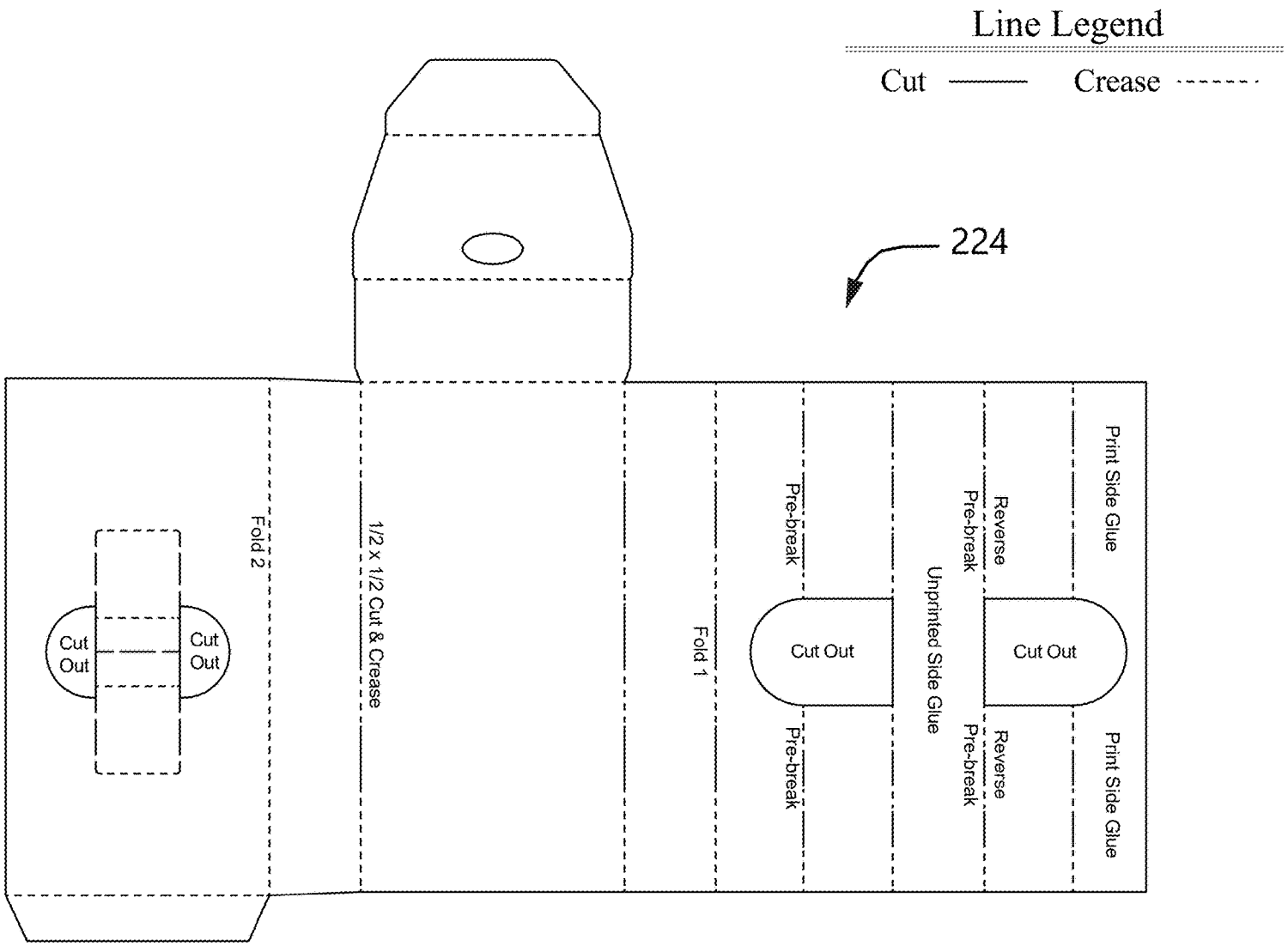
FIGS. 17A and 17B show an example of the paperboard layout for a tray of the child resistant package.
Figure 17B:
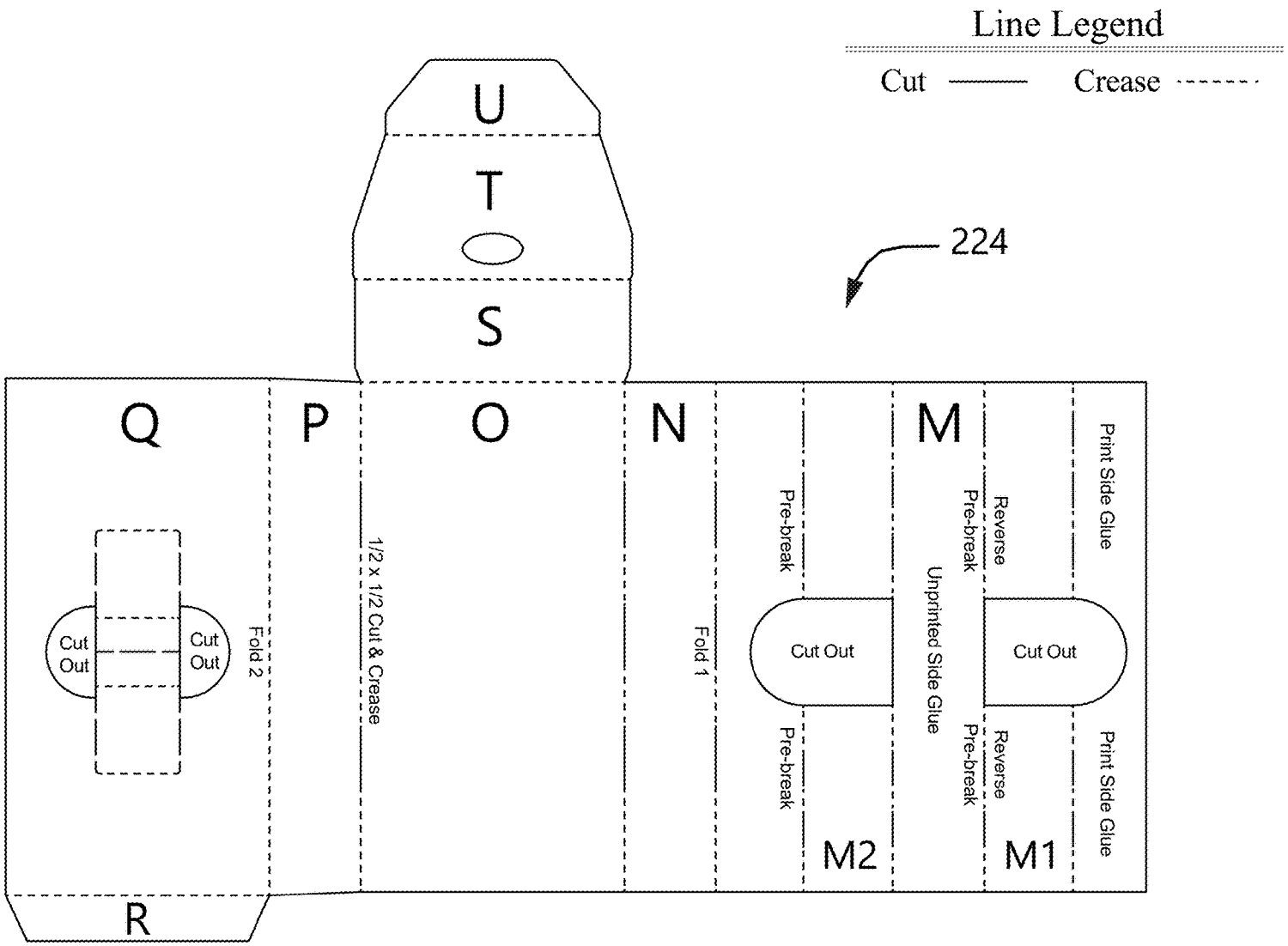

FIGS. 17A and 17B show an example of the layout of the paperboard for a tray 224 of the child resistant package 220. The tray 224 has a front end having a front opening and an extension panel 230 that includes a cover panel 232 and a tuck flap 234. The tray 224 has a rear end having a rear opening. In this example, the tray 224 has an additional opening on a side panel.

In FIG. 17B, different parts of the paperboard have been labeled from "M" to "U." The portions N, O, P, and Q form the sidewalls of the tray 224. The portions N, O, P, and Q of the tray 224 correspond to the side panels 228*b*, 228*a*, 228*d*, and 228*c*, respectively, shown in FIG. 10A. The portion M is folded to form support members. For example, the portions M1 and M2 correspond to the support members 310 in FIG. 10G. Portions of the portion M are attached (e.g., glued) to the inner walls of the side panels 228*a* and 228*c*. Near the front end, the portions S, T, and U correspond to the cover panel 232, the extension member 236, and the tuck flap locking tab 238, respectively.

Reference throughout this specification to "an embodiment" or "an example" or "an aspect" means that a particular feature, structure or characteristic described in connection with the embodiment, example or aspect is included in at least one embodiment, example or aspect. Appearances of the phrases "according to an embodiment," "according to an example" or "according to an aspect" in various places throughout this specification are not necessarily all referring to the same embodiment, example or aspect, but may refer to different embodiments, examples, or aspects. The particular features or characteristics may be combined in any suitable manner in one or more embodiments, examples, or aspects. Furthermore, while some embodiments, examples or aspects include some but not other features included in other embodiments, examples or aspects, combinations of features of different embodiments, examples or aspects are meant to be within the scope of the claims, and form different embodiments.

The following describes examples of the child resistant package.

Example 1: An apparatus comprising:

a container that is configured to have a first state and a second state, the container comprising:

an outer sleeve including a first set of side panels and an inner locking member, wherein the first set of side panels define a first opening, the first set of side panels include a first side panel, and the inner locking member is attached to an inner wall of the first side panel;

an inner sleeve that includes a second set of side panels and an extension panel, the second set of side panels define a second opening, the second set of side panels include a fifth side panel, the extension panel is coupled to the fifth side panel, the extension panel includes a cover panel and a tuck flap, and the tuck flap includes an extension member and a tuck flap locking member;

wherein in the first state of the container, the inner sleeve is positioned within the outer sleeve, the cover panel is configured to cover the second opening, the extension member and the tuck flap locking member are tucked between the inner sleeve and the outer sleeve, and the tuck flap locking member is configured to engage the inner locking member.

Example 2: The apparatus of example 1 wherein the container comprises a release member configured to, upon receiving an external force, bias the tuck flap locking member to disengage from the inner locking member.

Example 3: The apparatus of example 2 wherein the release member is formed by a predefined cut, crease, embossed area or graphically identified area on the first side panel of the outer sleeve.

Example 4: The apparatus of any of examples 1 to 3 wherein the outer sleeve comprises a rectangular or square cross sectional shape, the first set of side panels comprises a second side panel, a third side panel, and a fourth side panel, the first and second side panels are parallel to each other, and the third and fourth side panels are parallel to each other.

Example 5: The apparatus of example 4 wherein the inner sleeve comprises a sixth side panel, a seventh side panel, and an eighth side panel, the fifth side panel is parallel to the sixth side panel, the seventh side panel is parallel to the eighth side panel, and in the first state of the container the tuck flap locking member and at least a portion of the extension member are tucked between the first side panel of the outer sleeve and the sixth side panel of the inner sleeve.

Example 6: The apparatus of any of examples 1 to 5 wherein the inner sleeve comprises a bias member, when the container is in the first state, the bias member is configured to bias the tuck flap locking member towards a first position to engage the inner locking member.

Example 7: The apparatus of example 6 wherein the outer sleeve comprises a release member configured to, upon receiving an external force, bias the tuck flap locking member to a second position to disengage from the inner locking member.

Example 8: The apparatus of any of examples 1 to 7 wherein the inner locking member and the first side panel of the outer sleeve are formed by a first continuous sheet of material, the inner locking member is folded at a first fold line inwards relative to the first side panel, the inner locking member is secured to an inner wall of the first side panel, producing a first step profile in which a first step is formed by a first edge of the inner locking member.

Example 9: The apparatus of example 8 wherein the extension member and the tuck flap locking member are formed by a second continuous sheet of material, the tuck flap locking member is folded at a second fold line outwards relative to the extension member, wherein in the first state of the container, the extension member and the tuck flap locking member form a second step profile in which a second step is formed by a second edge of the tuck flap locking member, the second step profile complements the first step profile, and the second edge of the tuck flap locking member engages the first edge of the inner locking member.

Example 10: The apparatus of any of examples 1 to 9 wherein in the second state of the container, the tuck flap locking member of the inner sleeve is disengaged from the inner locking member of the outer sleeve, enabling at least a portion of the inner sleeve to extend out of the outer sleeve;

wherein the outer sleeve defines an opening;

wherein the inner sleeve comprises a first end and a second end, when the inner sleeve is fully in the outer sleeve, the first end is closer to the opening of the outer sleeve than the second end, and the tuck flap locking member is positioned closer to the first end than the second end;

wherein the inner sleeve comprises a second locking member closer to the second end than the first end, the second locking member has a third edge that is configured to engage the inner locking member of the outer sleeve when a predefined portion of the inner sleeve extends outside of the outer sleeve, preventing the inner sleeve to further extend out of the outer sleeve.

Example 11: The apparatus of example 10 wherein the first edge of the inner locking member has a width that is greater than a width of the second edge of the tuck flap locking member, the third edge of the second locking member of the inner sleeve has a width that is greater than the width of the second edge of the tuck flap locking member, the inner sleeve comprises a release member having a width sufficient to bias the second edge of the tuck flap locking member to entirely disengage from the first edge of the inner locking member upon receiving a first external force, and the width of the release member is not sufficient to bias the third edge of the second locking member to entirely disengage from the first edge of the inner locking member upon receiving a second external force comparable to the first external force.

Example 12: The apparatus of any of examples 4 to 11 wherein the inner sleeve comprises a sixth side panel, seventh side panel, and an eighth side panel, the fifth side panel is parallel to the sixth side panel, the seventh side panel is parallel to the eighth side panel, and the tuck flap locking member and at least a portion of the extension member are tucked in the space between the first side panel and the fifth side panel when the container is in the first state.

Example 13: The apparatus of any of examples 5 to 11 wherein the outer sleeve is made of a first continuous sheet of material, and the inner sleeve is made of a second continuous sheet of material.

Example 14: The apparatus of any of examples 1 to 13 wherein the cover panel, the extension member, and the tuck flap locking member are formed by a triple fold.

Example 15: The apparatus of any of examples 1 to 14 wherein the container comprises a folded board.

Example 16: The apparatus of example 15 in which the container comprises a folded paperboard or cardboard.

Example 17: The apparatus of example 16 in which the container comprises a lining on the paperboard to form a moisture or oil barrier, and enhance tear-resistant properties of the paperboard.

Example 18: The apparatus of example 17 in which the lining comprises at least one of polyresin or bioresin.

Example 19: An apparatus comprising:

a container comprising an outer package and an inner tray, wherein the container is configured to have an open state and a closed state;

wherein the outer package comprises an inner locking member, and the inner tray comprises a tuck flap locking member;

wherein when the container is in the closed state, the inner tray is positioned within the outer package, and the tuck flap locking member is tucked between the inner tray and the outer package and configured to engage the inner locking member;

wherein the outer package comprises a release member configured to, upon receiving an external force, bias the tuck flap locking member to disengage from the inner locking member, enabling the container to transition to the open state, allowing the inner tray to move relative to the outer package and extend at least partially outside of the outer package.

Example 20: The apparatus of example 19 wherein the release member is formed by a predefined cut, crease, embossed area or graphically identified area on a side panel of the outer package.

Example 21: The apparatus of example 19 or 20 wherein the inner tray comprises a fifth side panel, a sixth side panel, a seventh side panel, and an eighth side panel, the fifth side panel is parallel to the sixth side panel, and the seventh side panel is parallel to the eighth side panel;

wherein the inner tray comprises an extension panel coupled to the fifth side panel, the extension panel includes a cover panel and a tuck flap, and the tuck flap includes an extension member and the tuck flap locking member;

wherein in the closed state of the container, the tuck flap locking member and at least a portion of the extension member are tucked between the outer package and the sixth side panel of the inner tray.

Example 22: The apparatus of example 21 wherein the outer package comprises a rectangular or square cross sectional shape, the outer package comprises a first side panel, a second side panel, a third side panel, and a fourth side panel, the first and second side panels are parallel to each other, the third and fourth side panels are parallel to each other, and the inner locking member is attached to an inner wall of the first side panel.

Example 23: The apparatus of example 21 or 22 wherein when the container is in the closed state, the sixth side panel is configured to bias the tuck flap locking member towards a first position to engage the inner locking member on the outer package.

Example 24: The apparatus of example 23 wherein the release member is configured to, upon receiving the external force, bias the tuck flap locking member to a second position to disengage from the inner locking member.

Example 25: The apparatus of any of examples 21 to 24 wherein the cover panel, the extension member, and the tuck flap locking member are formed by a triple fold.

Example 26: The apparatus of any of examples 19 to 25 wherein the outer package comprises a first side panel, the inner locking member and the first side panel are formed by a first continuous sheet of material, the inner locking member is folded at a first fold line inwards relative to the first side panel, the inner locking member is secured to an inner wall of the first side panel producing a first step profile in which a first step is formed by a first edge of the inner locking member.

Example 27: The apparatus of example 26 wherein the inner container comprises a fifth side panel and an extension panel coupled to the fifth side panel, the extension panel includes a cover panel and a tuck flap, and the tuck flap includes an extension member and the tuck flap locking member;

wherein the extension member and the tuck flap locking member are formed by a second continuous sheet of material, the tuck flap locking member is folded at a second fold line outwards relative to the extension member;

wherein in the closed state of the container, the extension member and the tuck flap locking member are tucked between the inner tray and the outer package to cause the tuck flap to press against the extension member and form a second step profile in which a second step is formed by a second edge of the tuck flap locking member, and the second edge of the tuck flap locking member engages the first edge of the inner locking member.

Example 28: The apparatus of example 27 wherein the inner tray comprises a first end and a second end, the tuck flap locking member is positioned closer to the first end than the second end, the inner tray comprises a second locking member closer to the second end than the first end, the second locking member has a third edge that is configured to engage the inner locking member of the outer package when a predefined portion of the inner tray extends out of the outer package to prevent the inner tray from further extending out of the outer package.

Example 29: The apparatus of example 28 wherein the first edge of the inner locking member has a width that is greater than a width of the second edge of the tuck flap locking member, the third edge of the second locking member of the inner tray has a width that is greater than the width of the second edge of the tuck flap locking member, the release member has a width sufficient to bias the second edge of the tuck flap locking member to entirely disengage from the first edge of the inner locking member upon receiving a first external force, and the width of the release member is not sufficient to bias the third edge of the second locking member to entirely disengage from the first edge of the inner locking member upon receiving a second external force comparable to the first external force.

Example 30: The apparatus of any of examples 19 to 29 wherein the inner tray comprises a second locking member, when the container is in the open state, the second locking member is configured to engage the inner locking member of the outer package when a predefined portion of the inner tray extends out of the outer package, preventing the inner tray from further extending out of the outer package.

Example 31: The apparatus of any of examples 19 to 30 wherein the outer package comprises a first side panel, the inner tray comprises a fifth side panel, the inner locking member and the first side panel are made of a first continuous sheet of material, and the extension panel and the fifth side panel are made of a second continuous sheet of material.

Example 32: The apparatus of any of examples 19 to 31 wherein the bias member comprises a panel that divides the chamber into a first sub-chamber and a second sub-chamber, the first sub-chamber is configured to receive an object to be stored in the container, the second sub-chamber is configured to receive the extension member and the tuck flap locking member when the container is in the closed state.

Example 33: A method of packaging a product, the method comprising:

providing a container comprising an outer package and an inner tray, wherein the container is configured to have an open state and a closed state;

wherein the outer package comprises an inner locking member, and the inner tray comprises a tuck flap locking member;

placing the product in the inner tray; and closing the container by inserting the inner tray into the outer package, tucking the tuck flap locking member between the inner tray and the outer package, causing the tuck flap locking member to engage the inner locking member, and transitioning the container to the closed state;

wherein the outer package comprises a release member configured to, upon receiving an external force, bias the tuck flap locking member to disengage from the inner locking member, enabling the container to transition to the open state, allowing the inner tray to move relative to the outer package and extend at least partially outside of the outer package.

Example 34: An apparatus comprising:

a container comprising:

an outer sleeve comprising side panels defining a chamber having a first opening, the side panels including a first side panel;

an inner tray comprising side panels defining a space for holding a product, the side panels defining a second opening, the side panels comprising a fifth side panel;

wherein the inner tray is configured to extend out of the outer sleeve through the first opening;

wherein the inner tray further comprises an extension panel that includes a cover panel and a tuck flap, the tuck flap includes an extension member and a tuck flap locking member, wherein the extension panel and the first side panel are formed by a first continuous sheet of material, wherein the cover panel, the extension member, and the tuck flap locking member are formed by a triple fold, wherein in a closed state of the container, the cover panel is configured to cover the second opening, and the extension member and the tuck flap locking member are tucked between a fifth side panel of the inner tray and the first side panel of the outer sleeve;

wherein the outer sleeve comprises an inner locking member positioned in the chamber;

wherein the fifth side panel of the inner tray is configured to bias the tuck flap locking member towards a first position when the container is in the closed state and causing the tuck flap locking member to engage the inner locking member of the outer sleeve.

Example 35: The apparatus of example 34 wherein the container comprises a release member configured to, upon receiving an external force, bias the tuck flap locking member to a second position to cause the tuck flap locking member to disengage from the inner locking member.

Example 36: An apparatus comprising:

a container comprising:

an outer cell comprising a first continuous sheet of material forming side panels, an inner locking member, and a release member, wherein the outer cell defines a chamber having a first opening; and an inner cell comprising a second continuous sheet of material forming side panels and an extension panel, wherein the inner cell has dimensions selected to enable the inner cell to fit in the chamber of the outer cell, the extension panel is coupled to one of the side panels, the extension panel includes an extension member and a tuck flap locking member;

wherein when the container is in a closed state, the inner cell is fully inserted into the chamber of the outer cell and the tuck flap locking member is tucked between one of the side panels of the inner cell and one of the side panels of the outer cell, and the tuck flap locking member is configured to engage the inner locking member;

wherein the release member is configured to, upon receiving an external force, bias the tuck flap locking member to disengage from the inner locking member, enabling the inner cell to extend from the outer cell through the first opening.

Example 37: The apparatus of example 36 wherein the inner cell defines a second opening, the extension panel includes a cover panel and a tuck flap, and the tuck flap includes the extension member and the tuck flap locking member;

wherein when the container is in the closed state, the cover panel is configured to cover the second opening.

Example 38: An apparatus comprising:

a container comprising an outer cell and an inner cell, the outer cell comprising an inner locking member, the inner cell comprising a cover panel and a tuck flap formed by a triple fold, wherein in a closed state of the container, the cover panel is configured to cover an opening of the inner cell, and at least a portion of the tuck flap is configured to be tucked between the outer cell and the inner cell and engage an inner locking member;

the container further comprising a release member configured to bias the tuck flap to disengage from the inner locking member, enabling the container to operate in an open state, allowing the inner cell to extend from the outer cell through an opening of the outer cell.

Example 39: The apparatus of example 38 wherein the container comprises a folded board.

Example 40: The apparatus of example 39 wherein the container comprises a folded paperboard or cardboard.

Example 41: The apparatus of example 40 wherein the container comprises a lining on the paperboard to form a moisture or oil barrier, and enhance tear-resistant properties of the paperboard.

Example 42: The apparatus of example 41 wherein the lining comprises at least one of polyresin or bioresin.

What is claimed is:

1. An apparatus comprising:

a container that is configured to have a first state and a second state, the container comprising:

an outer sleeve including a first set of side panels and an inner locking member, wherein the first set of side panels define a first opening, the first set of side panels include a first side panel, and the inner locking member is attached to an inner wall of the first side panel;

an inner sleeve that includes a second set of side panels and an extension panel, the second set of side panels define a second opening, the second set of side panels include a fifth side panel, the extension panel is coupled to the fifth side panel, the extension panel includes a cover panel and a tuck flap, and the tuck flap includes an extension member and a tuck flap locking member;

wherein in the first state of the container, the inner sleeve is positioned within the outer sleeve, the cover panel is configured to cover the second opening, the extension member and the tuck flap locking member are tucked between the inner sleeve and the outer sleeve, and the tuck flap locking member is configured to engage the inner locking member.

2. The apparatus of claim 1 wherein the container comprises a release member configured to, upon receiving an external force, bias the tuck flap locking member to disengage from the inner locking member.

3. The apparatus of claim 2 wherein the release member is formed by a predefined cut, crease, embossed area or graphically identified area on the first side panel of the outer sleeve.

4. The apparatus of claim 1 wherein the outer sleeve comprises a rectangular or square cross sectional shape, the first set of side panels comprises a second side panel, a third side panel, and a fourth side panel, the first and second side panels are parallel to each other, and the third and fourth side panels are parallel to each other.

5. The apparatus of claim 4 wherein the inner sleeve comprises a sixth side panel, a seventh side panel, and an eighth side panel, the fifth side panel is parallel to the sixth side panel, the seventh side panel is parallel to the eighth side panel, and in the first state of the container the tuck flap locking member and at least a portion of the extension member are tucked between the first side panel of the outer sleeve and the sixth side panel of the inner sleeve.

6. The apparatus of claim 1 wherein the inner sleeve comprises a bias member, when the container is in the first state, the bias member is configured to bias the tuck flap locking member towards a first position to engage the inner locking member.

7. The apparatus of claim 6 wherein the outer sleeve comprises a release member configured to, upon receiving an external force, bias the tuck flap locking member to a second position to disengage from the inner locking member.

8. The apparatus of claim 1 wherein the inner locking member and the first side panel of the outer sleeve are formed by a first continuous sheet of material, the inner locking member is folded at a first fold line inwards relative to the first side panel, the inner locking member is secured to an inner wall of the first side panel, producing a first step profile in which a first step is formed by a first edge of the inner locking member.

9. The apparatus of claim 8 wherein the extension member and the tuck flap locking member are formed by a second continuous sheet of material, the tuck flap locking member is folded at a second fold line outwards relative to the extension member, wherein in the first state of the container, the extension member and the tuck flap locking member form a second step profile in which a second step is formed by a second edge of the tuck flap locking member, the second step profile complements the first step profile, and the second edge of the tuck flap locking member engages the first edge of the inner locking member.

10. The apparatus of claim 1 wherein in the second state of the container, the tuck flap locking member of the inner sleeve is disengaged from the inner locking member of the outer sleeve, enabling at least a portion of the inner sleeve to extend out of the outer sleeve;

wherein the outer sleeve defines an opening;

wherein the inner sleeve comprises a first end and a second end, when the inner sleeve is fully in the outer sleeve, the first end is closer to the opening of the outer sleeve than the second end, and the tuck flap locking member is positioned closer to the first end than the second end;

wherein the inner sleeve comprises a second locking member closer to the second end than the first end, the second locking member has a third edge that is configured to engage the inner locking member of the outer sleeve when a predefined portion of the inner sleeve extends outside of the outer sleeve, preventing the inner sleeve to further extend out of the outer sleeve.

11. The apparatus of claim 10 wherein the first edge of the inner locking member has a width that is greater than a width of the second edge of the tuck flap locking member, the third edge of the second locking member of the inner sleeve has a width that is greater than the width of the second edge of the tuck flap locking member, the inner sleeve comprises a release member having a width sufficient to bias the second edge of the tuck flap locking member to entirely disengage from the first edge of the inner locking member upon receiving a first external force, and the width of the release member is not sufficient to bias the third edge of the second locking member to entirely disengage from the first edge of the inner locking member upon receiving a second external force comparable to the first external force.

12. The apparatus of claim 4 wherein the inner sleeve comprises a sixth side panel, seventh side panel, and an eighth side panel, the fifth side panel is parallel to the sixth side panel, the seventh side panel is parallel to the eighth side panel, and the tuck flap locking member and at least a portion of the extension member are tucked in the space between the first side panel and the fifth side panel when the container is in the first state.

13. The apparatus of claim 5 wherein the outer sleeve is made of a first continuous sheet of material, and the inner sleeve is made of a second continuous sheet of material.

14. The apparatus of claim 1 wherein the cover panel, the extension member, and the tuck flap locking member are formed by a triple fold.

15. The apparatus of claim 1 wherein the container comprises a folded board.

16. The apparatus of claim 15 in which the container comprises a folded paperboard or cardboard.

17. The apparatus of claim 16 in which the container comprises a lining on the paperboard to form a moisture or oil barrier, and enhance tear-resistant properties of the paperboard.

18. The apparatus of claim 17 in which the lining comprises at least one of polyresin or bioresin.

19. An apparatus comprising:

a container comprising an outer package and an inner tray, wherein the container is configured to have an open state and a closed state;

wherein the outer package comprises an inner locking member, and the inner tray comprises side panels and an extension panel coupled to one of the side panels, the side panels define an opening, the extension panel includes a cover panel and a tuck flap, and the tuck flap includes an extension member and a tuck flap locking member;

wherein when the container is in the closed state, the inner tray is positioned within the outer package, the cover panel is configured to cover the opening, and the extension member and the tuck flap locking member are tucked between the inner tray and the outer package and configured to engage the inner locking member;

wherein the outer package comprises a release member configured to, upon receiving an external force, bias the tuck flap locking member to disengage from the inner locking member, enabling the container to transition to the open state, allowing the inner tray to move relative to the outer package and extend at least partially outside of the outer package.

20. An apparatus comprising:

a container comprising:

an outer sleeve comprising side panels defining a chamber having a first opening, the side panels including a first side panel;

an inner tray comprising side panels defining a space for holding a product, the side panels defining a second opening, the side panels comprising a fifth side panel;

wherein the inner tray is configured to extend out of the outer sleeve through the first opening;

wherein the inner tray further comprises an extension panel that includes a cover panel and a tuck flap, the tuck flap includes an extension member and a tuck flap locking member, wherein the extension panel and the fifth side panel are formed by a first continuous sheet of material, wherein the cover panel, the extension member, and the tuck flap locking member are formed by a triple fold, wherein in a closed state of the container, the cover panel is configured to cover the second opening, and the extension member and the tuck flap locking member are tucked between a fifth side panel of the inner tray and the first side panel of the outer sleeve;

wherein the outer sleeve comprises an inner locking member positioned in the chamber;

wherein the fifth side panel of the inner tray is configured to bias the tuck flap locking member towards a first position when the container is in the closed state and causing the tuck flap locking member to engage the inner locking member of the outer sleeve.

* * * * *